US011696615B2

(12) United States Patent
Pantazelos et al.

(10) Patent No.: US 11,696,615 B2
(45) Date of Patent: Jul. 11, 2023

(54) SAFETY MECHANISM FOR USE WITH SNOW SPORT BOOT AND BINDING SYSTEM

(71) Applicant: Stop River Development LLC, Park City, UT (US)

(72) Inventors: George Pantazelos, Park City, UT (US); Joseph K. Lane, Branford, CT (US); Michael Ryan Cameron, Nashua, NH (US)

(73) Assignee: Stop River Development LLC, Park City, UT (US)

( * ) Notice: Subject to any disclaimer, the term of this patent is extended or adjusted under 35 U.S.C. 154(b) by 413 days.

(21) Appl. No.: 16/800,718

(22) Filed: Feb. 25, 2020

(65) Prior Publication Data

US 2020/0268095 A1 Aug. 27, 2020

Related U.S. Application Data

(60) Provisional application No. 62/810,051, filed on Feb. 25, 2019.

(51) Int. Cl.
*A43B 5/04* (2006.01)
*A63C 9/088* (2012.01)
(Continued)

(52) U.S. Cl.
CPC ..... *A43B 5/0421* (2013.01); *A63C 9/0802* (2013.01); *A63C 9/086* (2013.01);
(Continued)

(58) Field of Classification Search
CPC ..... A43B 5/0421; A43B 3/34; A43B 5/0415; A63C 9/0802; A63C 9/08557;
(Continued)

(56) References Cited

U.S. PATENT DOCUMENTS 3,165,328 A 1/1965 Franklin
3,318,610 A 5/1967 Kulick
(Continued)

FOREIGN PATENT DOCUMENTS

CN 1736515 A 2/2006
CN 206636380 U * 11/2017
(Continued)

OTHER PUBLICATIONS

Neptune, R.R. et al., "A New Electromechanical Ski Binding with Release Sensitivity to Torsion and Bending Moments Transmitted by the Leg", Skiing Trauma and Safety, 1996, pp. 339-353, vol. 10, ASTM STP 1266, American Society for Testing and Materials.
(Continued)

*Primary Examiner* — James A Shriver, II
*Assistant Examiner* — Michael T. Walsh
(74) *Attorney, Agent, or Firm* — Intrinsic Law Corp.

(57) ABSTRACT

An apparatus for charge-assisted release of a ski binding includes an explosive material, a battery, an electrical circuit, and a processor. The explosive material is mounted on or in a ski, a ski boot, and/or a ski binding. The electrical circuit extends from the explosive material to the battery, the electrical circuit including a switch having a connected state in which the battery and the explosive material are electrically connected through the switch and a disconnected state in which the battery and the explosive material are electrically disconnected. The processor is electrically coupled to the switch and configured to generate an output signal that transitions the switch from the disconnected state to the connected state in response to an input signal from one or more sensors.

25 Claims, 21 Drawing Sheets

(51) Int. Cl.

| | |
|---|---|
| ***A63C 9/08*** | (2012.01) |
| ***A63C 9/085*** | (2012.01) |
| ***A63C 9/086*** | (2012.01) |
| ***F42B 3/04*** | (2006.01) |
| ***A63C 10/12*** | (2012.01) |

(52) U.S. Cl.
CPC ..... *A63C 9/088* (2013.01); *A63C 9/08557* (2013.01); *A63C 10/12* (2013.01); *F42B 3/04* (2013.01); *A63C 2203/24* (2013.01)

(58) Field of Classification Search
CPC ..... A63C 9/086; A63C 9/088; A63C 10/12; A63C 2203/24; A63C 2203/12; A63C 2203/18; F42B 3/04
See application file for complete search history.

(56) References Cited

U.S. PATENT DOCUMENTS

| | | | | |
|---|---|---|---|---|
| 3,606,370 | A | 9/1971 | Spademan | |
| 3,671,054 | A * | 6/1972 | Mittelstadt | A63C 9/0802 280/DIG. 13 |
| 3,919,563 | A | 11/1975 | Lautier et al. | |
| 3,960,383 | A | 6/1976 | O'Neil | |
| 4,063,752 | A | 12/1977 | Whitaker et al. | |
| 4,130,296 | A | 12/1978 | D'Antonio et al. | |
| 4,270,770 | A | 6/1981 | Spademan | |
| 4,291,894 | A * | 9/1981 | D'Antonio | A63C 9/088 280/611 |
| 4,360,218 | A | 11/1982 | Spademan | |
| 4,385,773 | A | 5/1983 | Scheck et al. | |
| 4,415,176 | A | 11/1983 | Hull et al. | |
| 4,436,321 | A | 3/1984 | Storandt et al. | |
| 4,492,387 | A | 1/1985 | Spademan | |
| 4,522,423 | A | 6/1985 | Haldemann et al. | |
| 4,536,006 | A | 8/1985 | Haldemann et al. | |
| 4,600,214 | A | 7/1986 | Spademan | |
| 4,640,026 | A | 2/1987 | Kirsch | |
| 4,657,277 | A | 4/1987 | Haldemann et al. | |
| 4,735,845 | A | 4/1988 | Haldemann et al. | |
| 4,846,492 | A * | 7/1989 | Bataille | A63C 9/086 36/117.3 |
| 5,755,046 | A | 5/1998 | Dodge | |
| 6,007,086 | A * | 12/1999 | Hopkins | A63C 9/0802 280/632 |
| 6,095,547 | A | 8/2000 | Vandergrift et al. | |
| 6,338,497 | B1 | 1/2002 | Chevalier et al. | |
| 6,742,801 | B1 | 6/2004 | Dodge | |
| 6,769,711 | B1 | 8/2004 | Marlin et al. | |
| 7,063,345 | B2 | 6/2006 | Holzer | |
| 7,837,218 | B2 | 11/2010 | Flaig | |
| 7,841,614 | B2 | 11/2010 | Saloman | |
| 8,439,389 | B2 | 5/2013 | Moore et al. | |
| 8,746,728 | B2 * | 6/2014 | Shute | A63C 9/006 280/607 |
| 8,990,048 | B2 | 3/2015 | Czaja et al. | |
| 9,545,972 | B2 | 1/2017 | Williams | |
| 10,569,155 | B2 * | 2/2020 | Pantazelos | A63C 9/088 |
| 10,780,340 | B2 | 9/2020 | Carradine | |
| 2003/0094788 | A1 | 5/2003 | Jacobs | |
| 2006/0107827 | A1 * | 5/2006 | Richards | F41H 9/02 86/50 |
| 2009/0212534 | A1 | 8/2009 | Mercat et al. | |
| 2011/0057420 | A1 | 3/2011 | Walker | |
| 2016/0178337 | A1 * | 6/2016 | Graber | F42B 12/36 102/482 |
| 2017/0080325 | A1 * | 3/2017 | Barden | A63C 9/0885 |
| 2018/0264348 | A1 | 9/2018 | Pantazelos et al. | |
| 2018/0264349 | A1 * | 9/2018 | Aanes | A63C 9/0807 |

FOREIGN PATENT DOCUMENTS

| | | | | |
|---|---|---|---|---|
| DE | 4446260 | A1 * | 8/1995 | A63C 10/10 |
| DE | 4446260 | A1 | 8/1995 | |
| DE | 10309388 | A1 | 9/2004 | |
| DE | 102007001599 | A1 * | 7/2007 | A63C 11/227 |
| ES | 2341826 | B1 | 5/2011 | |
| FR | 2348719 | A1 * | 4/1976 | |
| FR | 2348719 | A1 | 11/1977 | |
| FR | 2348719 | A1 * | 11/1977 | |
| IT | 1044301 | B * | 2/1980 | A43B 5/0417 |
| SI | 24286 | A * | 8/2014 | |
| WO | WO8203183 | A1 | 9/1982 | |
| WO | WO-0205909 | A1 * | 1/2002 | A63C 9/005 |
| WO | WO-2019010739 | A1 * | 1/2019 | |

OTHER PUBLICATIONS

Wunderly, G. et al.,"A New Electromechanical Binding/Dynamometer for Actively Controlled Snow Ski Binding Systems", Skiing Trauma and Safety, 1987, pp. 249-259, Sixth International Symposium, ASTM STP 938, American Society for Testing and Materials, Philadelphia.

Hull, M.L., "A Survey of Actively Controlled (Electronic) Snow Ski Bindings", Skiing Trauma and Safety, 1985, pp. 238-257, Fifth International Symposium, ASTM STP 860, American Society for Testing and Materials, Philadelphia.

Eseltine, K. et al., "An Alpine Ski Binding with Electrically Modulated Twist Release", Skiing Trauma and Safety, 1993, pp. 200-212, Ninth International Symposium, ASTM STP 1182, American Society for Testing and Materials, Philadelphia.

Wunderly, G. et al., "A Mechanical Alpine Ski Binding with Programmable Release", Skiing Trauma and Safety, 1989, pp. 199-209, Seventh International Symposium, ASTM STP 1022, American Society for Testing and Materials, Philadelphia.

Wunderly, G. et al.,"Measurement of Boot Loads Using a Second-Generation Microcomputer-Controlled Snow Ski Binding System", Skiing Trauma and Safety, 1989, pp. 181-198, Seventh International Symposium, ASTM STP 1022, American Society for Testing and Materials, Philadelphia.

Hull, M.L. et al., "Electromechanical Ski Release Binding with Mechanical Backup," Skiing Trauma and Safety, 1997, pp. 81-92, vol. 11, ASTM STP 1289, American Society for Testing and Materials.

Caldwell, B. et al., "A New Mechanical Ski Binding with Heel Release Activated by the Bending Moment at the Boot Sole", Skiing Trauma and Safety, 1993, pp. 189-199, Ninth International Symposium, ASTM STP 1182, American Society for Testing and Materials, Philadelphia.

MacGregor, D. et al., "Field Testing of a Microcomputer-Controlled Snow Ski Binding System", Skiing Trauma and Safety, 1985, pp. 258-281, Fifth International Symposium, ASTM STP 860, American Society for Testing and Materials, Philadelphia.

Shealy, J.E. et al., "What do we Know About Ski Injury Research that Relates Binding Function to Knee and Lower Leg Injuries?", Skiing Trauma and Safety, 2003, pp. 36-52, vol. 14, ASTM STP 1440, ASTM International, West Conshohocken, PA.

Ettlinger, C.F. et al., "Where do we go From Here?", Skiing Trauma and Safety, 2003, pp. 53-63, vol. 14, ASTM STP 1440, ASTM International, West Conshohocken, PA.

Gulick, D.W. et al., "Design of a Learning Binding for Alpine Skiing", Skiing Trauma and Safety, 2000, pp. 30-49, vol. 13, ASTM STP 1397, American Society for Testing and Materials, West Conshohocken, PA.

Crawford, R.P. et al., "Fuzzy Logic Control of Bioadaptive Ski Binding Release", Skiing Trauma and Safety, 1995, pp. 323-338, vol. 10, ASTM STP 1266, American Society for Testing and Materials, Philadelphia.

Goodwin, D.A. et al., "Variable Influence in On-Snow Ski Boot Pressure Measurements", Skiing Trauma and Safety, 2000, pp. 50-67, vol. 13, ASTM STP 1397, American Society for Testing and Materials, West Conshohocken, PA.

Extended European Search Report, (EESR) for EP Application No. 20762260.6, dated Apr. 19, 2022.

* cited by examiner

SAFETY MECHANISM FOR USE WITH SNOW SPORT BOOT AND BINDING SYSTEM

RELATED APPLICATIONS

This application claims priority to U.S. Provisional Application No. 62/810,051, filed on Feb. 25, 2019, titled "Sport Boot Binding and Controls," which is hereby incorporated by reference.

TECHNICAL FIELD

This application is generally directed to boots and boot binding release systems used in ski and board (snow) sports.

BACKGROUND

Various sports employ a sport boot coupled to another sporting platform (e.g., a ski or board) by way of a binding that controllably releases the boot or user's foot from the platform. The release of the user's foot or boot from the platform is for safety reasons (e.g., to avoid excessive forces or twist of a user's foot) in case of an accident. In most current systems the release occurs when a mechanical threshold, e.g., a force exceeds a preset limit. The binding then mechanically decouples the user's foot or boot to set the platform (ski, board) free.

These conventional bindings are of limited use in protecting from very rapid events such as those experienced in competition sports like downhill skiing. Injuries to users include bone fractures, spinal injuries, concussions and other head injuries. More particularly in winter mountain sports, anterior cruciate ligament (ACL) injuries are far too common. Conventional bindings are manually adjusted based on anecdotal experience or approximate metrics, have finite (mechanical) response times, and do not sufficiently or effectively respond to prevent or reduce ACL or other injuries. Attempts to modernize bindings and binding release systems have not resulted in effective or commercially viable alternatives to current systems.

SUMMARY

Example embodiments described herein have innovative features, no single one of which is indispensable or solely responsible for their desirable attributes. The following description and drawings set forth certain illustrative implementations of the disclosure in detail, which are indicative of several exemplary ways in which the various principles of the disclosure may be carried out. The illustrative examples, however, are not exhaustive of the many possible embodiments of the disclosure. Without limiting the scope of the claims, some of the advantageous features will now be summarized. Other objects, advantages and novel features of the disclosure will be set forth in the following detailed description of the disclosure when considered in conjunction with the drawings, which are intended to illustrate, not limit, the invention.

A processor-controlled snow sport safety system, comprising a boot binding assembly having one or more mechanical engagement points at which a snow sport boot is mechanically secured by said boot binding assembly during use in a snow sport; a chemical energy storage reservoir containing an explosive material or chemical charge which when exploded releases stored energy from said explosive material, in an exothermic reaction, into said chemical energy storage reservoir; a processor circuit electrically coupled to and receiving one or more input signals from respective one or more sensors, and providing an output signal in response to the one or more input signals, the output signal triggering an explosion of said explosive material within said chemical energy storage reservoir; an actuator assembly coupled to said chemical energy storage reservoir, the actuator comprising a moveable member that moves into a release position within the actuator assembly in response to and proportionally to a force delivered by said exothermic reaction; and a boot release member, mechanically coupled to said moveable member, which releases said boot from said boot binding from said one or more mechanical engagement points when the moveable member is moved into said release position.

In some aspects, said boot release member displaces said snow sport boot in a vertical direction relative to said boot binding assembly upon movement of the moveable member into said release position. In other aspects, said boot release member displaces said snow sport boot in a horizontal direction relative to said boot binding assembly upon movement of the moveable member into said release position.

In some aspects, said boot release member comprises a cable connected at one end to said boot binding assembly such that a movement of said moveable member of the actuator assembly causes a corresponding force on said cable. And in some aspects, said actuator assembly comprises a piston within said actuator assembly and said piston is driven by a force from said exothermic reaction. The one or more sensors may comprise an accelerometer and/or a gyroscope and may be coupled to a user's body, clothing, boots, bindings, or snow sport boards or combinations thereof so as to detect a fall or other trigger event that should release the user from his or her snow sport boards (e.g., skis). Therefore, to avoid injury to the skier, the skier's skis may be separated from the skier upon falling, preferably prior to the skier reaching safety nets, trail-side vegetation or other objects that could injure a skier if he or she were to contact such object while wearing the skis or snow sport boards. Specifically, the invention can reduce or eliminate injuries to skiers' anterior cruciate ligament (ACL) which is a common injury that occurs when fallen skiers become entangled with safety nets or barriers that catch the skis of the user and twist their legs. The invention, in some aspects, avoids this situation by quickly detecting a fall (using sensors and processors) then triggering an output signal (using a trigger signal from a processor) such as an electrical voltage signal, which detonates a stored charge or explosive that in turn forces an actuator and moveable member to release the boot of the skier from the boot binding. The result is that the fallen skier would quickly shed the skis and (more) safely slide into the trail-side safety nets, vegetation or other terrain and solid objects that the skier might encounter upon falling, without dragging the skis along in the process.

In some embodiments, the user's boots are forced out of a conventional boot binding using an upward or lateral (forward-backward) force and movement that overcomes the bindings' release settings. In other embodiments, the force from the exothermic reaction acts through said actuator and moveable release members to open, separate or otherwise modify the boot bindings to rapidly release the user's boots therefrom.

BRIEF DESCRIPTION OF THE DRAWINGS

For a fuller understanding of the nature and advantages of the present concepts, reference is made to the following detailed description of preferred embodiments and the accompanying drawings.

DETAILED DESCRIPTION

Figure 1:
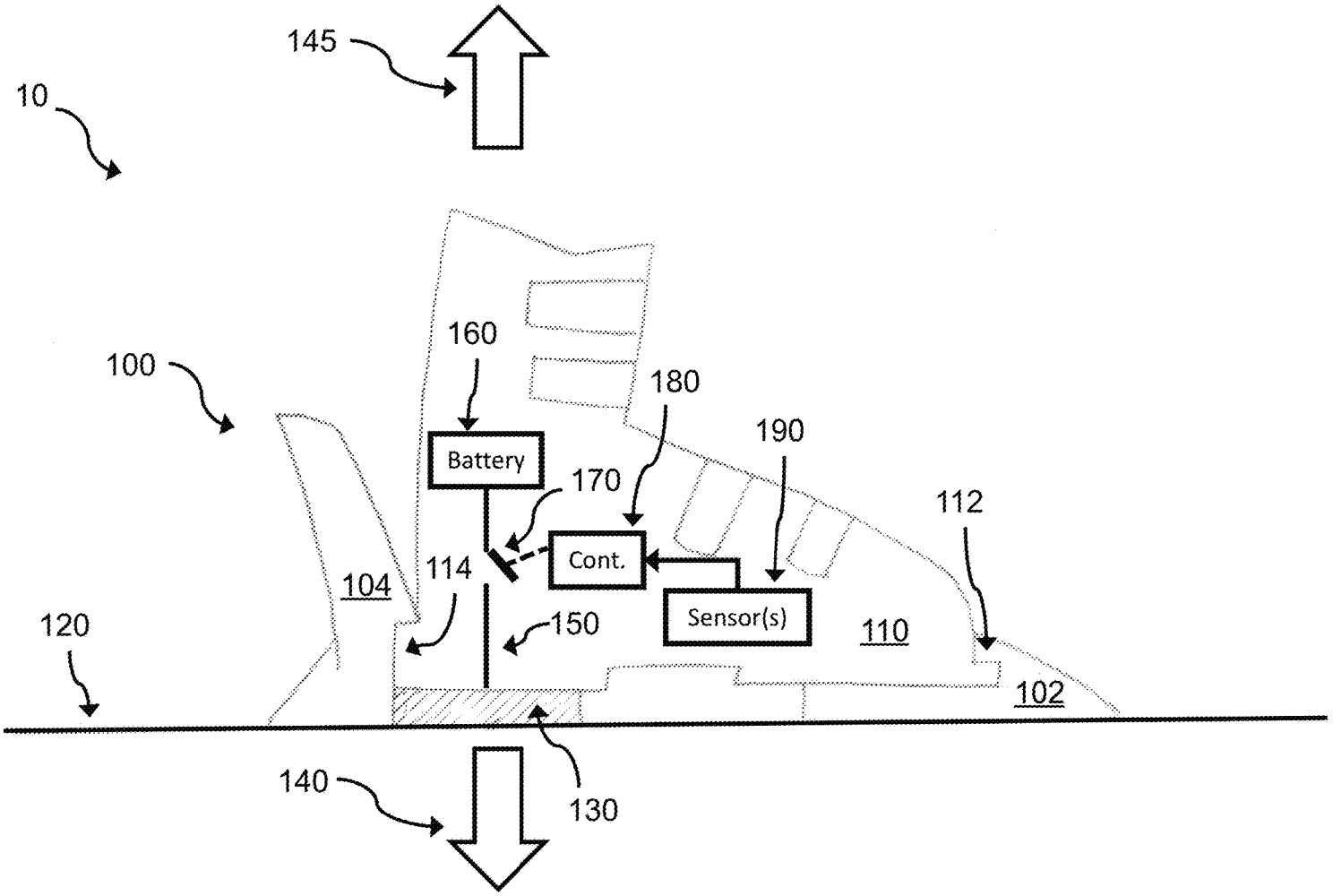
FIG. 1 is a side view of a charge-assisted binding release system according to an embodiment.

FIG. 1 is a side view of a charge-assisted binding release system 10 according to an embodiment. The system 10 includes a ski binding 100, a boot 110, and a ski 120. The ski binding 100 is attached to the ski 120, such as by screws, bolts or other attachment mechanisms. The boot 110 is releasably mechanically attached to the ski binding 100 (e.g., a ski binding assembly). For example, a toe lip 112 of the boot 110 is releasably mechanically attached to a toe piece 102 of the ski binding 100. In addition, a heel lip 114 of the boot 110 is releasably mechanically attached to a heel piece 104 of the ski binding 100. Together, the toe piece 102 and the heel piece 104 of the ski binding 100 comprise mechanical engagement points that releasably secure the boot 110 onto the ski 120.

An explosive device 130 is disposed on or in the boot 110. The explosive device 130 is configured to generate a force, upon activation, reaction, and/or explosion, that causes the ski binding 100 to release the boot 110. The force is greater than the mechanical clamping force of the binding 100 (e.g., by the mechanical engagement points) to retain the boot 110 during use. The explosive device 130 is preferably located below the heel or heel lip 114 of the boot 110, as illustrated in FIG. 1, such that the explosive device 130 is disposed against or adjacent to the ski 120. For example, the explosive device 130 can be mounted on the bottom of the boot 110 in place of a heel lift. In this position, the explosive device 130 can generate a downward force 140 (e.g., normal to the plane of the ski 120) that causes the boot 110 to move upwards 145 and detach from the binding 100.

Figure 2:
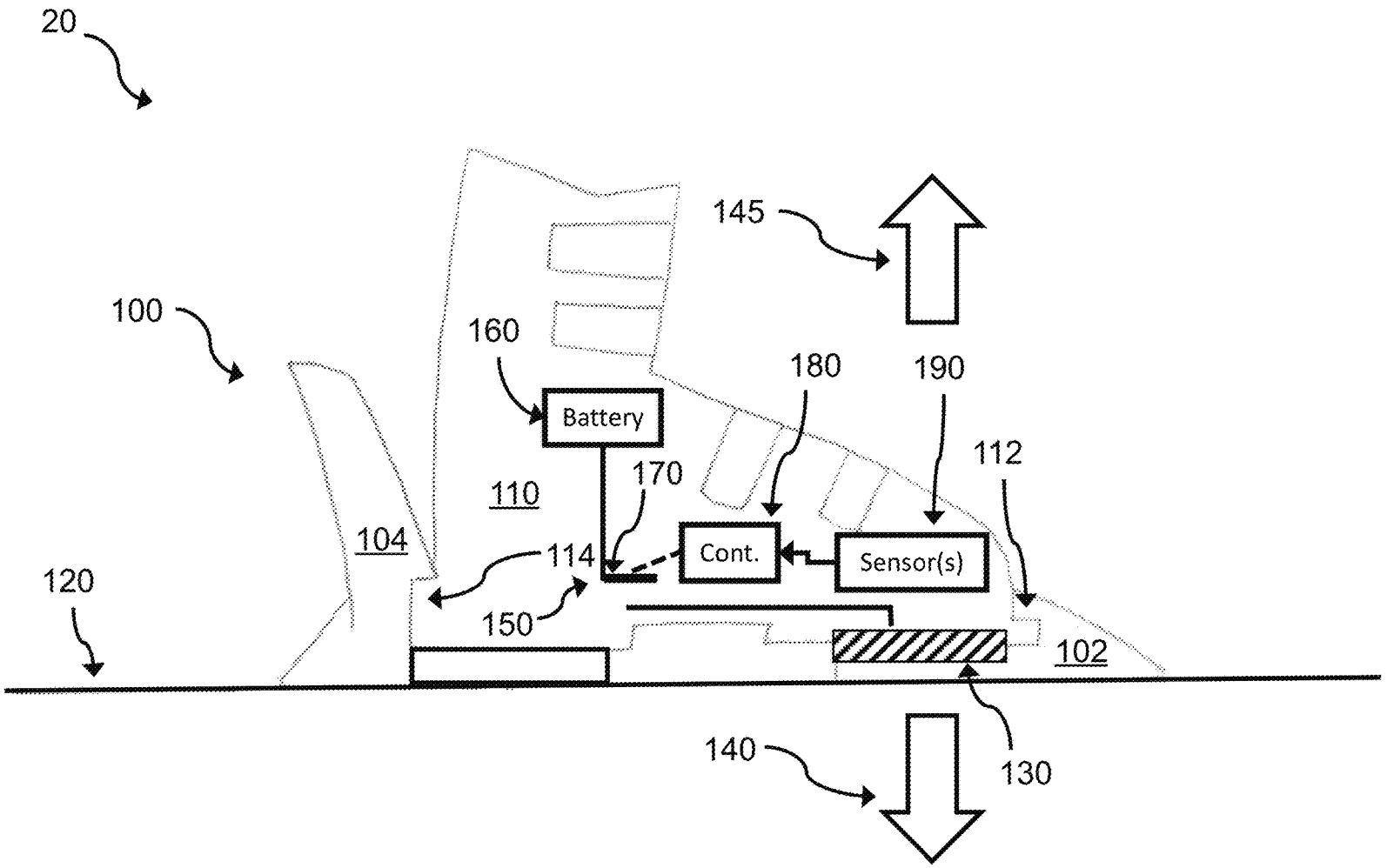
FIG. 2 is a side view of a charge-assisted binding release system according to an alternative embodiment.

In an alternative embodiment, the explosive device can be located below the toe or toe lip 112 of the boot 110 against or adjacent to the ski 120, as illustrated in system 20 in FIG. 2. For example, the explosive device 130 can be mounted on the bottom of the boot 110 in place of a toe lift.

The explosive device 130 is preferably located such that it generates an asymmetrical force on the boot 110 such that the force is primarily applied with respect to the heel or toe of the boot 110. This asymmetrical force can improve the likelihood that the boot 110 detaches from the binding 100 upon activation of the explosive device.

In some embodiments, the explosive device 130 includes an explosive material that, upon activation, reaction, and/or explosion, generates a gas that acts as a propellant to expand or fill a predefined volume. For example, the explosive material can be disposed inside an expandable device (e.g., an inflatable device), such as a bladder, that increases in volume when the explosive material is detonated. The bladder can be disposed between the sole of the boot 110 and the ski 120 to provide a force to detach the boot 110 from the binding 100 (e.g., at the mechanical engagement points of the boot binding assembly).

The explosive device 130 is electrically coupled to an electrical circuit 150 that can provide power to ignite, activate, react, and/or explode the explosive material in the explosive device 130. In one example, the power from the electrical circuit 150 initiates or triggers an exothermic chemical reaction in the explosive material. The power can be provided by a battery 160 or another energy-storage device. In a specific example, the battery 160 can be a 12V or a 9V battery. The electrical circuit 150 includes a switch 170 having a connected state and a disconnected state. In FIG. 1, the switch 170 is in the disconnected state where the switch 170 is disconnected from the battery 160. The state of the switch 170 is controllable through an output signal generated by a microprocessor-based controller 180. The controller 180 can generate the output signal based on input signals from one or more sensors 190. The input signals from the sensor(s) 580 can indicate whether the user (e.g. skier) has fallen and thus whether to change the state of the switch 570 to activate the explosive device 130 to detach the boot 110 from the binding 100. The electrical circuit 150, battery 160, switch 170, controller 180, and the sensor(s) 190 can be referred to as an activation circuit.

Though the activation circuit is illustrated in FIG. 1 as being disposed on the boot 110, it is noted that any of the activation circuit components (e.g., electrical circuit 150, battery 160, switch 170, controller 180, and/or the sensor(s) 190) can be disposed in another location, such as on the user's body, on the binding 100, or on the skis 120. In one example, the controller 180 and/or the sensor(s) 190 can comprise components of a smartphone or other electronic device held by or disposed on the user (e.g., in the user's pocket). In another example, some or all of the activation circuit (e.g., electrical circuit 150, battery 160, switch 170, controller 180, and/or the sensor(s) 190) can be disposed on or in the explosive device 130. In addition, it is noted that some or all of the explosive device 130 can be located on (e.g., mounted on or attached to) the ski 120 and/or the binding 100, in addition to or instead of being located on the boot 110.

In some embodiments, the activation circuit can be activated manually in addition to automatically (e.g., based on sensor data). For example, the skier can press a manual button that is electrically coupled (e.g., via a wire or wirelessly) to the processor to manually activate the explosive device 130.

Figure 3:
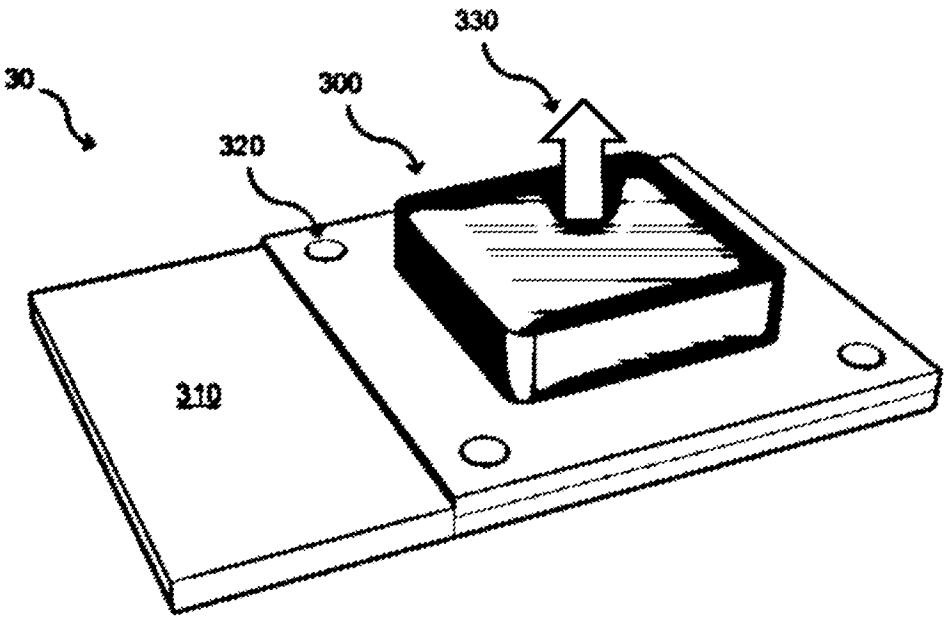
FIG. 3 is a perspective view of an explosive-induced expandable apparatus 30 according to an embodiment.

FIG. 3 is a perspective view of an explosive-induced expandable apparatus 30 according to an embodiment. The apparatus 30 includes an expandable device 300 that is disposed on a mounting plate 310. The mounting plate 310 includes mounting holes 320 that can receive screws, bolts, or other attachment mechanisms to releasably mount the apparatus 30 to sports equipment, such as to the ski boot 110 (e.g., to the sole, above the foot bed, behind the calf, etc.), ski binding 100, and/or to the ski 120. For example, the apparatus 30 can be mounted below the heel or heel lip 114 of boot 110 or below the toe or toe lip 112 of boot 110. In an embodiment, the apparatus 30 can be mounted on the bottom of a ski boot in place of a heel lift or a toe lift. The apparatus 30 can be mounted such that the expandable device 300 faces away from the boot's sole (and towards the binding and ski).

The expandable device 300 defines a cavity in which an explosive material is disposed. When the explosive material is activated, the explosive material releases stored energy to generate a gas (or gasses) that cause the expandable device 300 to increase in volume (e.g., to inflate or expand). The increase in volume of the expandable device 300 generates a force between the boot and the binding/ski which causes the binding to release the boot (e.g., at the mechanical engagement points of the boot binding assembly). The force is greater than the clamping force of the binding 100 to retain the boot 110 during use. In addition, the force delivered by the expandable device 300 is proportional to and in response to the force or energy delivered by the activation or reaction (e.g., exothermal reaction) of the explosive material. The expandable device 300 is in an unexpanded state in FIG. 3. In the expanded state, the expandable device 300 expands in volume away 330 from the mounting plate 310 towards the binding/ski. In some embodiments, the expandable device 300 can have be disposed in a rigid frame to force the expansion in volume away 330 from the mounting plate 310. Alternatively, the expandable device 300 can also expand horizontally in the plane parallel to the exposed surface of the mounting plate 310.

The expandable device 300 can comprise synthetic rubber (e.g., ethylene propylene diene monomer rubber, ethylene propylene monomer, neoprene, nitrile rubber), poly-paraphenylene terephthalamide (e.g., Kevlar®), nylon, polyurethane, polyester, polyethylene, polyvinylchloride, a fluoropolymer elastomer (e.g., Viton®), or another expandable material.

Figure 4:
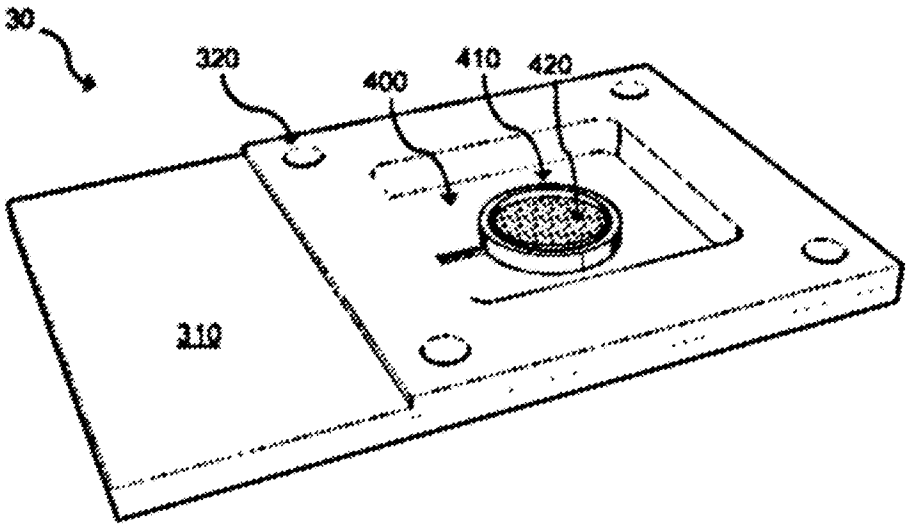
FIG. 4 is a perspective view of the explosive-induced expandable apparatus illustrated in FIG. 3 with the expandable device removed.

FIG. 4 is a perspective view of the explosive-induced expandable apparatus 30 with the expandable device 300 removed. As illustrated, the mounting plate 310 includes a hollow region 400 over which the expandable device 300 is mounted. A dish 410 is disposed in the hollow region 400 to hold the explosive material 420. One example of the explosive material 420 includes a mixture of NaN3, KNO3, and SiO2, such as in an airbag, which produces nitrogen gas upon activation/reaction/explosion. The hollow region 400 can define a volume to retain air (e.g., between the dish 410 and the perimeter 405 of the hollow region 400) that can react with the explosive material 420. In some embodiments, the hollow region 400 and the dish 410 can comprise a chemical energy storage reservoir.

In an alternative embodiment, the explosive material can be disposed in a cylinder (e.g., a chemical energy storage reservoir) to transfer force to a moveable mechanical component, such as a piston, cable, rod, or other moveable member that is attached thereto. For example, the explosive material can be disposed in a hydraulic cylinder. The mechanical component can be mechanically coupled to the boot or the binding to provide a force that causes the binding to release the boot (e.g., at the mechanical engagement points of the boot binding assembly).

Figure 5:
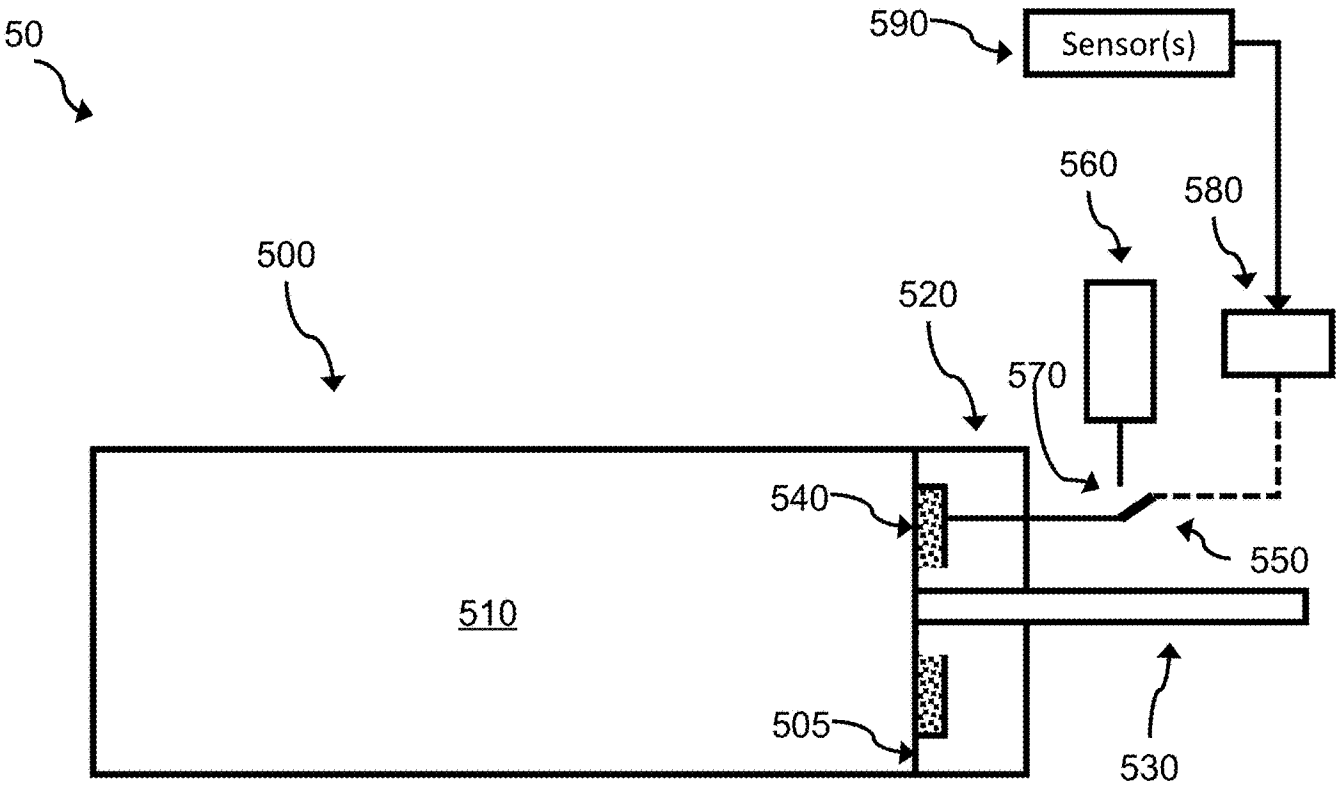
FIG. 5 is a cross-sectional view of an explosive-induced mechanical translation apparatus in a first state (e.g., a deactivated state) according to an embodiment.

FIG. 5 is a cross-sectional view of an explosive-induced mechanical translation apparatus 50 in a first state (e.g., a deactivated state) according to an embodiment. The apparatus 50 includes a cylinder 500 having an internal moveable wall 505 that defines first and second chambers 510, 520. A mechanical component 530 (e.g., a piston, cable, rod, or other moveable member) extends from the internal wall 505 through the second chamber 520 and an end of the cylinder 500 to an external location. An explosive material 540 is disposed in the second chamber 520 and comprises stored chemical energy. The second chamber 520 can function as a chemical energy storage reservoir in some embodiments. The first chamber 510 and the internal moveable wall 505 can function as an actuator assembly. The internal moveable wall 505 can function as a moveable member.

The explosive material 540 is coupled to an electrical circuit 550 that can provide power to ignite, activate, initiate, and/or trigger the detonation, explosion, chemical reaction of (e.g., exothermic reaction of) the explosive material 540 to release the stored chemical energy of the explosive material into the second chamber 520 (e.g., the chemical energy storage reservoir). The power can be provided by a battery 560 or another energy-storage device. In a specific example, the battery 560 can be a 12V or a 9V battery. The electrical circuit 550 includes a switch 570 having a connected state and a disconnected state. In FIG. 5, the switch 570 is in the disconnected state where the switch 570 is disconnected from the battery 560. The state of the switch 570 is controllable through an output signal generated by a microprocessor-based controller 580. The controller 580 can generate the output signal based on input signals from one or more sensors 590. The input signals from the sensor(s) 580 can indicate whether the user (e.g., skier) has fallen and thus whether to activate the change the state of the switch 570 to activate the explosive-induced mechanical translation apparatus 50.

The explosive-induced mechanical translation apparatus 50 can be disposed (e.g., mounted and/or attached) on or in sports equipment to release a sports boot from a binding, such as on or in ski boot 110 (e.g., on or in the sole, above the foot bed, behind the calf, etc.), on or in ski binding 100, and/or on or in the ski 120.

Figure 6:
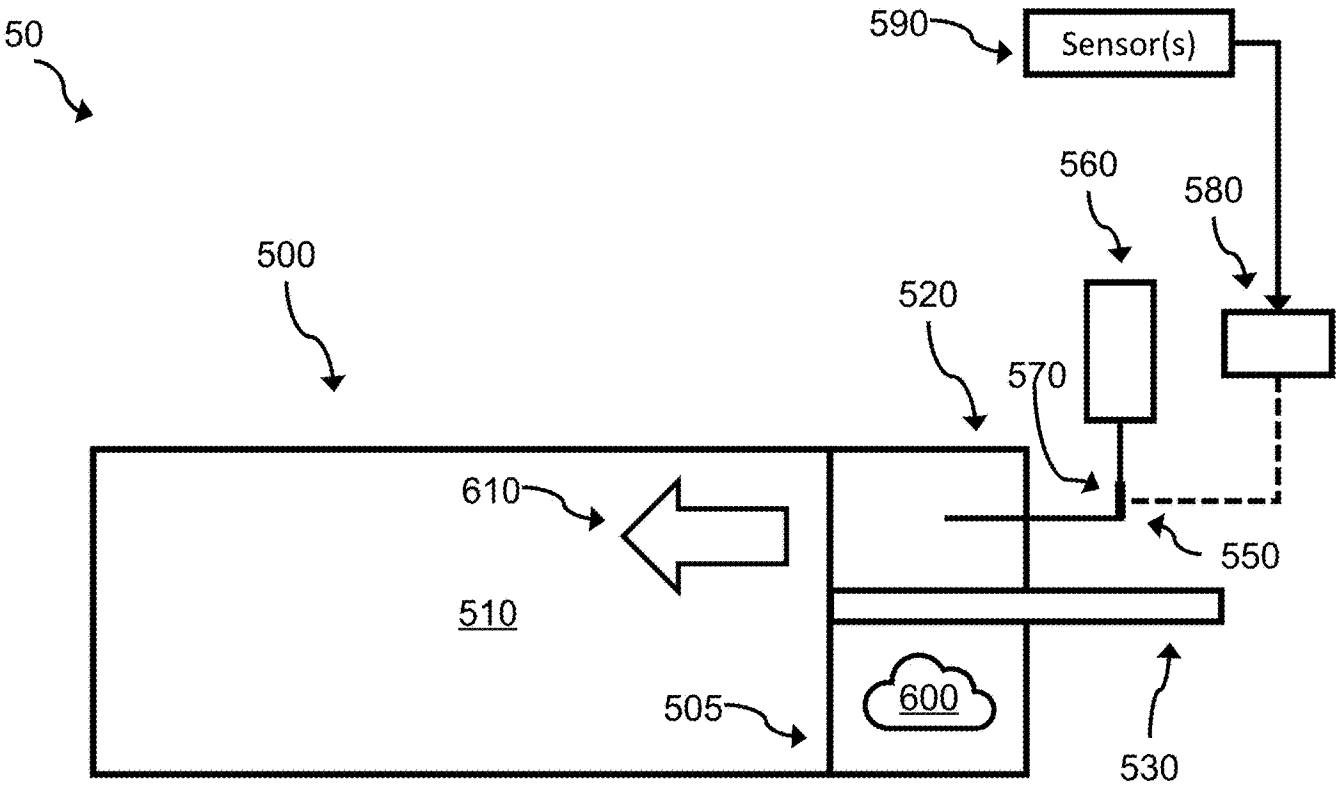
FIG. 6 is a cross-sectional view of the explosive-induced mechanical translation apparatus illustrated in FIG. 5 in a second state (e.g., an activated state).

FIG. 6 is a cross-sectional view of the explosive-induced mechanical translation apparatus 50 in a second state (e.g., an activated state). In the second state, the controller 580 generates an output signal that closes the switch 570 to complete the electrical circuit 550 between the explosive material 540 and the battery 560. The battery 560 provides power to ignite, activate, initiate reaction of, detonate, and/or explode the explosive material 540, which releases the stored chemical energy of the explosive material 540 at least in part by forming gas 600 in the second chamber 520 (e.g., the chemical energy storage reservoir). The gas 600 generates pressure in the second chamber 520 and causes the internal moveable wall 505 to translate 610 towards the first chamber 510, which in turn causes the mechanical component 530 to translate 610 towards the first chamber 510. The mechanical component 530 can be coupled to another mechanical component that can function as a boot release member to release the boot from the ski binding (e.g., at the mechanical engagement points of the boot binding assembly). Alternatively, the mechanical component 530 itself can function as a boot release member. The movement of the mechanical component 530 and optionally a boot release member mechanically coupled thereto is in response to and proportional to the energy or force delivered by the activation (e.g., exothermal chemical reaction) of the explosive material 540.

In an alternative embodiment, the explosive material 540 can be disposed in the first chamber 510. In this embodiment, the activation or detonation of the explosive material 540 generates the gas 600 and pressure in the first chamber 510 causing the internal moveable wall 505 to translate towards the second chamber 520, which in turn causes the mechanical component 530 to translate away from the first chamber 510 (e.g., in the opposite direction as translation 610).

In another alternative embodiment, the explosive material 540 can be replaced with a container (e.g., a cylinder) of compressed gas. When the switch 570 transitions to the connected state, a valve can release the compressed gas to cause the internal moveable wall 505 to translate towards the first or second chamber 510, 520 as in the explosive material embodiments described above.

Figure 7:
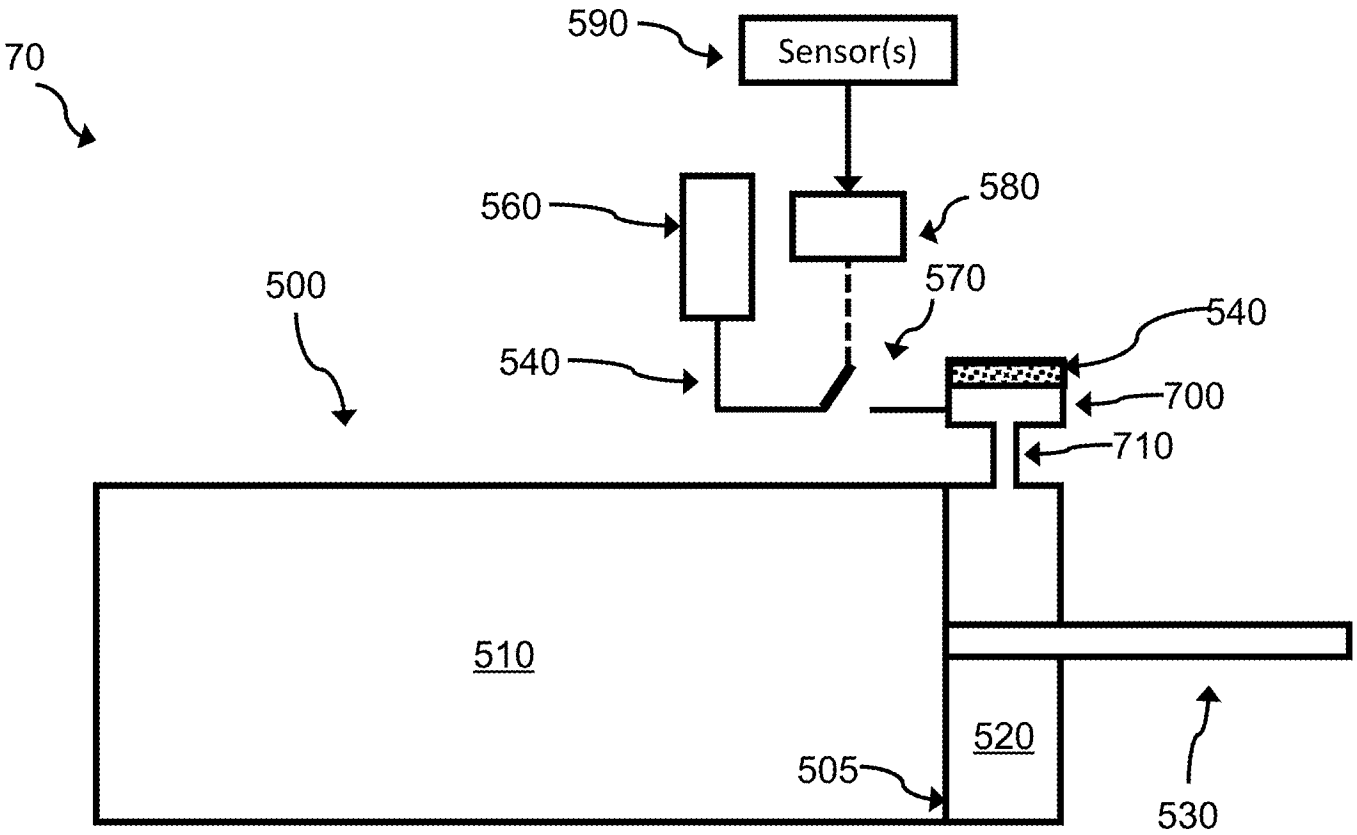
FIG. 7 is a cross-sectional view of an explosive-induced mechanical translation apparatus in a first state (e.g., a deactivated state) according to an alternative embodiment.

FIG. 7 is a cross-sectional view of an explosive-induced mechanical translation apparatus 70 in a first state (e.g., a deactivated state) according to an alternative embodiment. The apparatus 70 is the same as apparatus 50 except that the explosive material 540 is disposed in a third chamber 700 that is fluidly coupled to the second chamber 520 via a channel 710. The channel 710 can optionally include a valve (e.g., a one-way valve). The third chamber 700 can function as a chemical energy storage reservoir.

In an alternative embodiment, the third chamber 700 can be fluidly coupled to the first chamber 510 via channel 710.

The explosive-induced mechanical translation apparatus 70 can be disposed (e.g., mounted and/or attached) on or in sports equipment to release a sports boot from a binding, such as on or in ski boot 110 (e.g., on or in the sole, above the foot bed, behind the calf, etc.), on or in ski binding 100, and/or on or in the ski 120.

In another alternative embodiment, the third chamber 700, including the explosive material 540, can be replaced with a volume (e.g., a cylinder) of compressed gas. When the switch 570 transitions to the connected state, a valve can open to release the compressed gas to cause the internal moveable wall 505 to translate towards the first or second chamber 510, 520 as in the explosive material embodiments described above.

Figure 8:
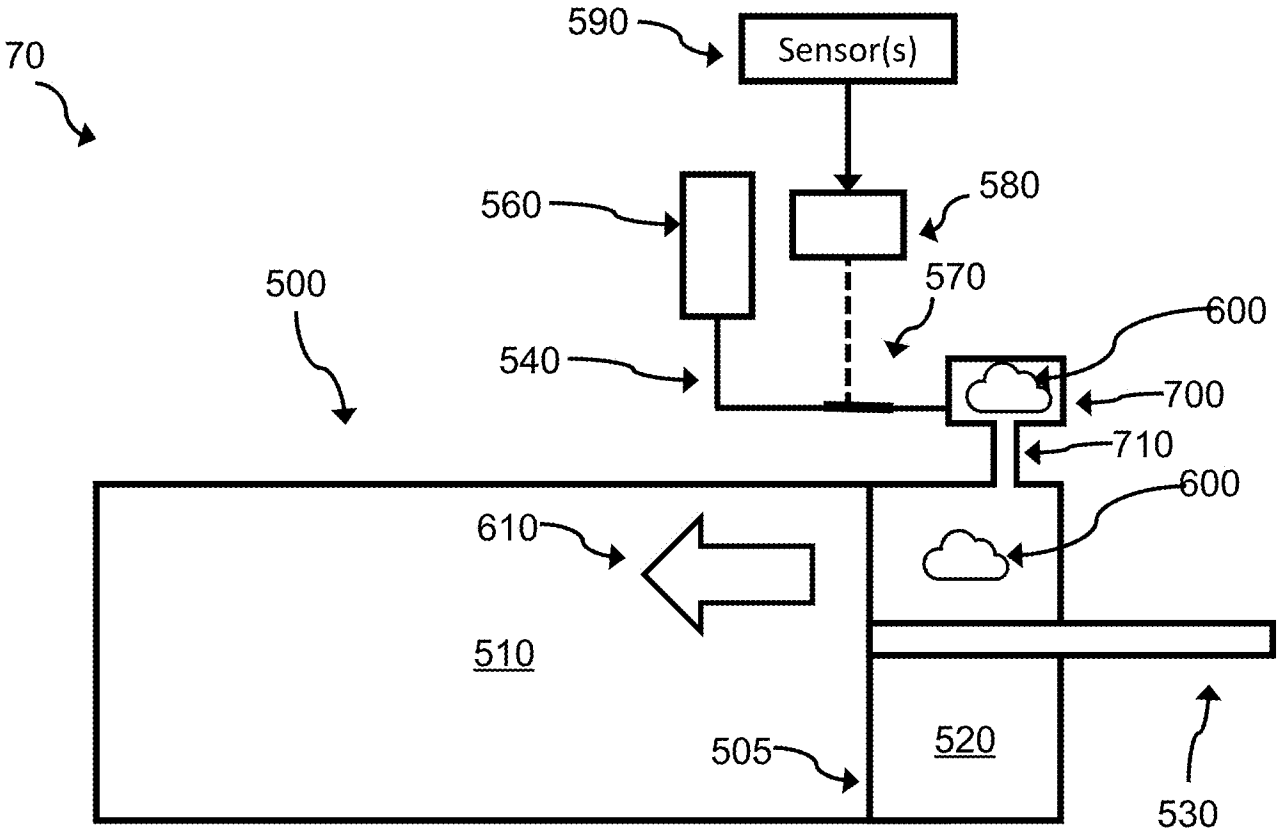
FIG. 8 is a cross-sectional view of the explosive-induced mechanical translation apparatus illustrated in FIG. 7 in a second state (e.g., an activated state) according to an alternative embodiment.

FIG. 8 is a cross-sectional view of the explosive-induced mechanical translation apparatus 70 in a second state (e.g., an activated state) according to an alternative embodiment. When the explosive material 540 is ignited, activated, reacted, detonated, and/or exploded, at least some of the gas 600 formed in the third chamber 700 flows into the second chamber 520 via a channel 710. As in apparatus 60, the gas 600 generates pressure in the second chamber 520 and causes the internal moveable wall 505 to translate 610 towards the first chamber 510, which in turn causes the mechanical component 530 (e.g., a moveable member) to translate 610 towards the first chamber 510. The movement of the mechanical component 530 and optionally a boot release member mechanically coupled thereto is in response to and proportional to the energy or force delivered by the activation (e.g., exothermal chemical reaction) of the explosive material 540.

In an alternative embodiment, the third chamber 700 can be fluidly coupled to the first chamber 510. In this embodiment, at least some of the gas 600, generated in the third chamber by the activation or detonation of the explosive material 540, flows into the first chamber 510 via the channel 710. The gas 600 generates pressure in the first chamber 510 causing the internal moveable wall 505 to translate towards the second chamber 520, which in turn causes the mechanical component 530 to translate away from the first chamber 510 (e.g., in the opposite direction as translation 610).

Figure 9:
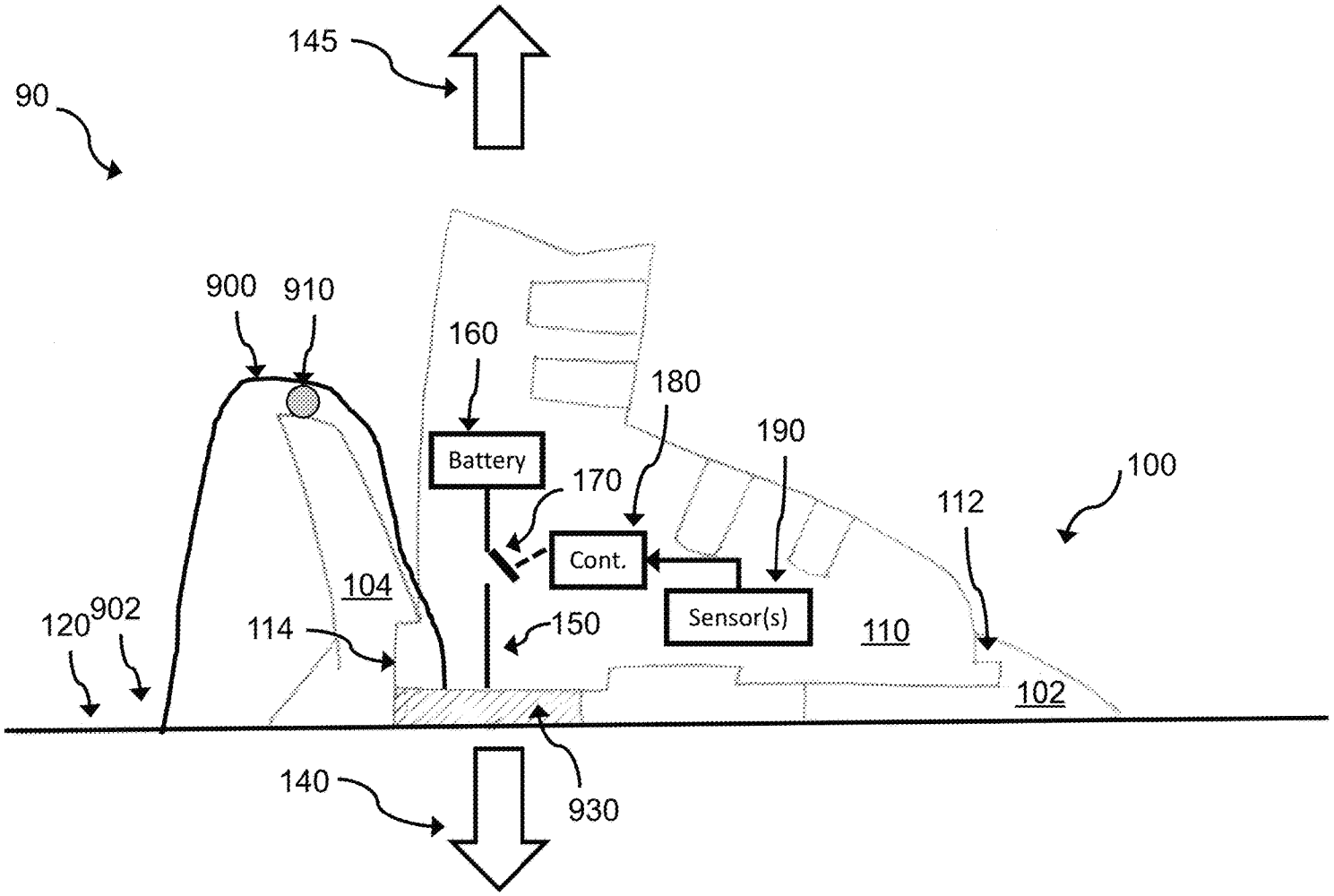
FIG. 9 is a side view of a charge-assisted binding release system according to an embodiment

FIG. 9 is a side view of a charge-assisted binding release system 90 according to an embodiment. System 90 is the same as system 10 except that the explosive device 130 is replaced with an explosive-induced mechanical translation apparatus 930 which can be the same as the explosive-induced mechanical translation apparatus 50, the explosive-induced mechanical translation apparatus 70, or the alternative embodiments of apparatus 50 or 70. When activated (e.g., ignited, reacted, detonated, and/or exploded), the explosive-induced mechanical translation apparatus 930 generates a force 140 on a cable 900 that extends from the boot 110 to the ski 120. The cable 900 passes over an optional pulley 910 that translates the downward force 140 at the explosive-induced mechanical translation apparatus 930 to an upward force 145 (e.g., in a vertical direction relative to the ski binding 100) at the ski 120. The ski 120 resists the upward force 145 which causes the boot 110 to move upward to displace the boot 110 vertically relative to the binding 100. The force is greater than the mechanical clamping force of the binding 100 to retain the boot 110 during use. In another embodiment, the second end 902 of the cable 900 can be coupled to the binding 100. The cable 900 can function as a boot release member.

The movement of the cable 900 is in response to and proportional to the energy or force delivered by the activation (e.g., exothermal chemical reaction) of the explosive material 540.

The explosive-induced mechanical translation apparatus 90 can be disposed (e.g., mounted and/or attached) on or in a portion of the boot 110 (e.g., on or in the sole, above the foot bed, behind the calf, etc.). Alternatively, the charge-assisted binding release system 90 can be located on the binding 100 and/or on the ski 120, in which case the cable 900 can be coupled to the boot 110 or the ski binding 100. For example, the locations of the charge-assisted binding release system 90 and the second end 902 of the cable 900 can be switched such that the charge-assisted binding release system 90 is disposed or mounted on the ski 120 and the second end 902 of the cable 900 is attached to the boot 110.

In another embodiment, the second end 902 of the cable 900 can be coupled to the binding 100.

Figure 10:
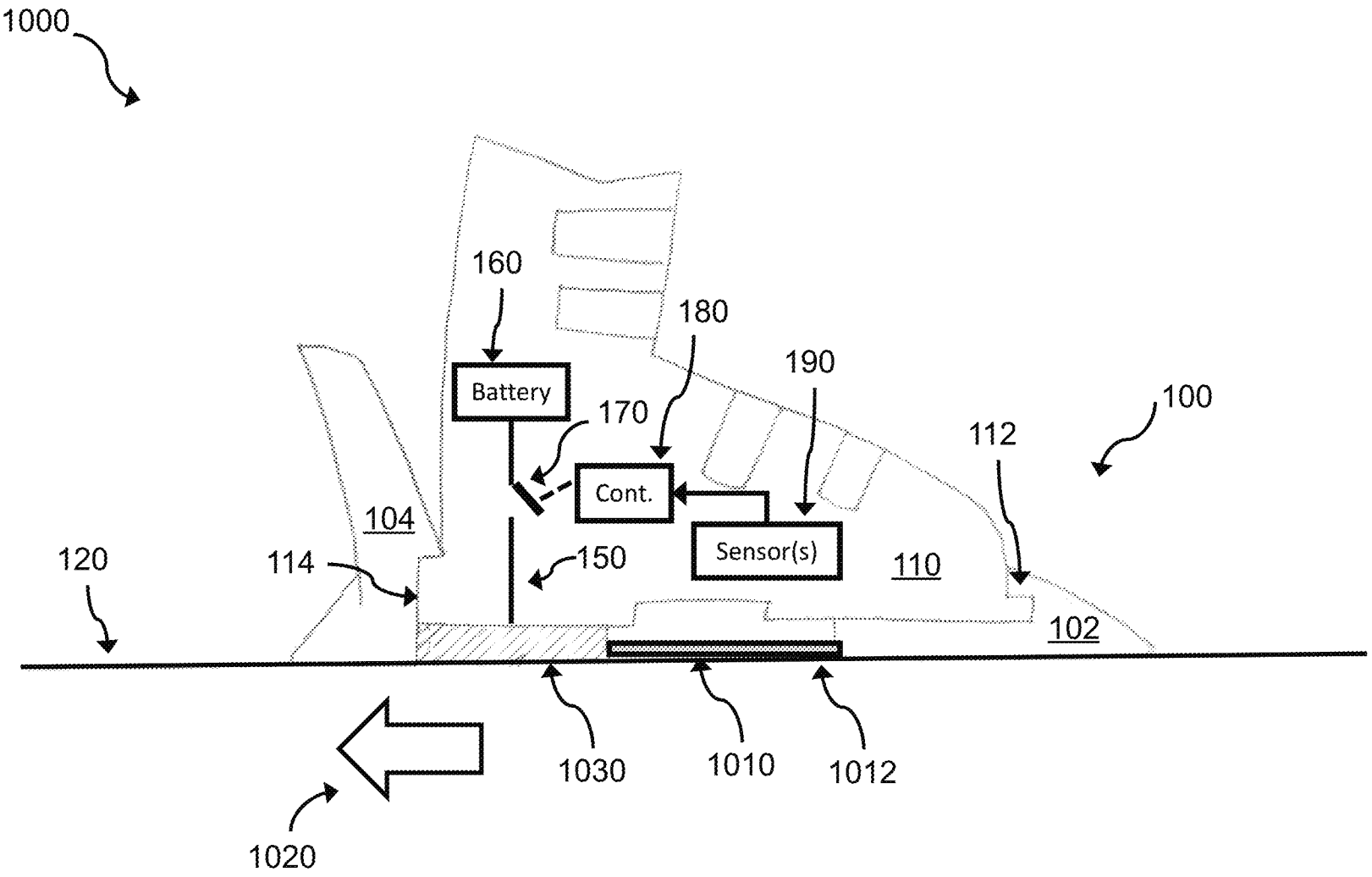
FIG. 10 is a side view of a charge-assisted binding release system according to another embodiment.

FIG. 10 is a side view of a charge-assisted binding release system 1000 according to another embodiment. System 1000 is the same as system 90 except that the explosive-induced mechanical translation apparatus 930 is replaced with an explosive-induced mechanical translation apparatus 1030, which can be the same as the explosive-induced mechanical translation apparatus 50, the explosive-induced mechanical translation apparatus 70, or the alternative embodiments of apparatus 50 or 70. When activated (e.g., ignited, reacted, detonated, and/or exploded), the explosive-induced mechanical translation apparatus 1030 pushes a rod or piston 1010 (e.g., a boot release member) that extends from the apparatus 1030 to the toe piece 102 of the ski binding 100. Pushing the rod or piston 1010 towards the toe piece 102 (e.g., in a horizontal direction relative to the ski binding 100) causes the apparatus 1030 and the boot 110 to move in the opposite direction 1020 toward the heel of the boot 110 to displace the boot 110 horizontally relative to the binding 100, which causes the binding 100 to release the boot 110. For example, the force in direction 1020 can compress a spring or other tension member in the heel piece 104 of the ski binding, which can cause the binding 100 to release the boot 110 (e.g., at the mechanical engagement points of the boot binding assembly). Additionally or alternatively, the force direction 1020 can cause the toe lip 112 of the boot 110 to move away from the toe piece 102 of the binding 100 to allow the boot 110 to be removed from the binding 100.

The movement of the rod or piston 1010 is in response to and proportional to the energy or force delivered by the activation (e.g., exothermal chemical reaction) of the explosive material 540.

The explosive-induced mechanical translation apparatus 1000 can be disposed on or in a portion of the boot 110 (e.g., on or in the sole, above the foot bed, behind the calf, etc.). Additionally or alternatively, the charge-assisted binding release system 1000 can be located on the binding 100 and/or on the ski 120. For example, the locations of the charge-assisted binding release system 1000 and the second end 1012 of the rod/piston 1010 can be switched such that the charge-assisted binding release system 100 is disposed or mounted on the ski 120 or binding 100 and the second end 1012 of the rod/piston 1010 extends to the heel of the boot 110. In another embodiment, the charge-assisted binding release system 1000 can be disposed on the back of the boot 110 such that the second end 1012 of the rod/piston 1010 presses on the binding 100 to release the binding 100 when the charge-assisted binding release system 1000 is activated.

In an alternative embodiment, the explosive-induced mechanical translation apparatus (e.g., apparatus 930, 1030) can be configured to generate a lateral or radial force that causes a portion of the boot 110 to twist into or out of the page in FIG. 9 or 10. For example, from the perspective of a user standing with a foot in the boot 110, the boot 110 can be twisted to the left or right (e.g., to displace the boot 110 laterally relative to the binding 100).

Figure 11:
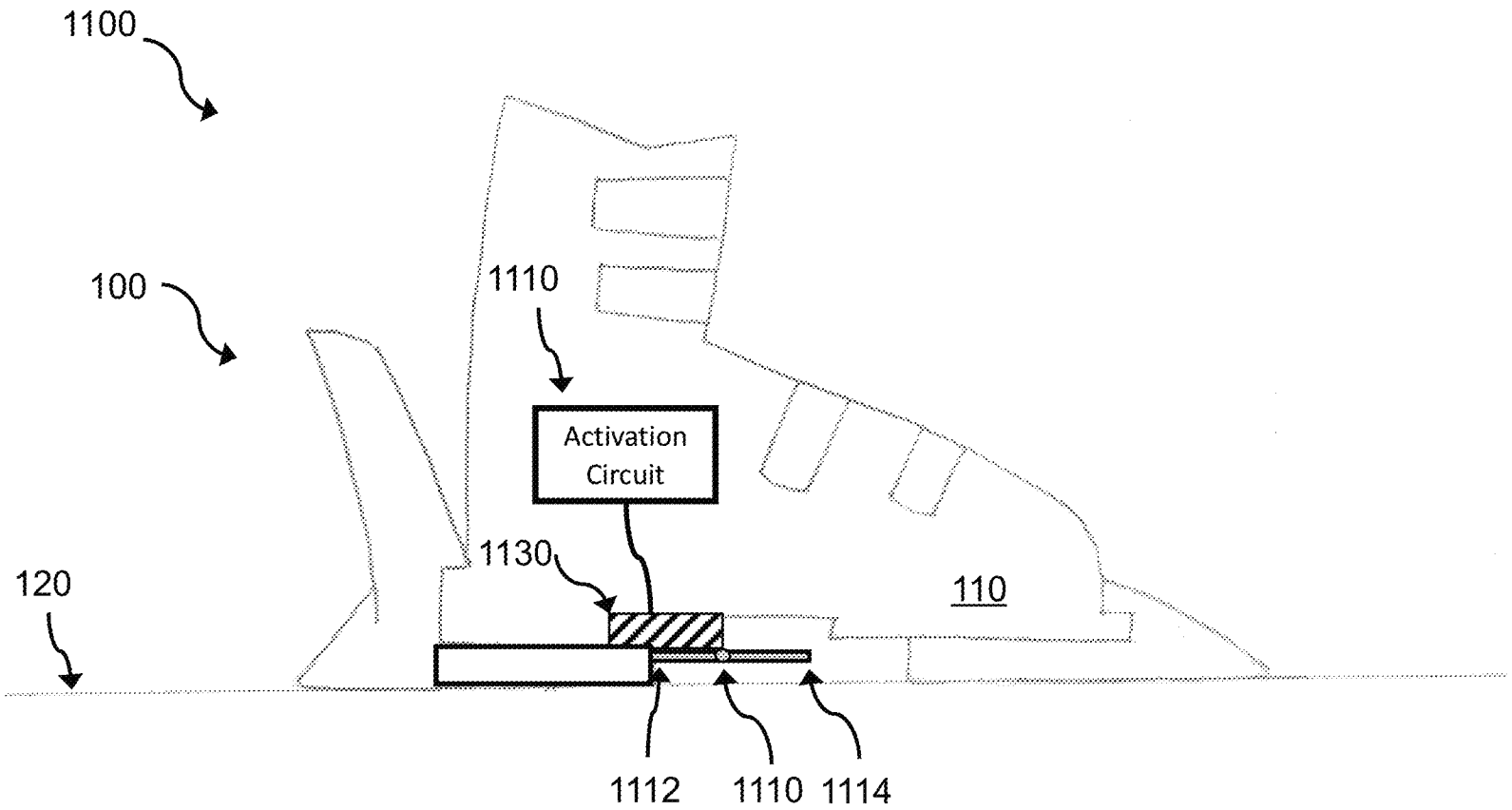
FIG. 11 is a side view of a charge-assisted binding release system in a first state (e.g., a deactivated state) according to another embodiment.

FIG. 11 is a side view of a charge-assisted binding release system 1100 in a first state (e.g., a deactivated state) according to another embodiment. System 1100 is the same as system 90 except that the explosive-induced mechanical translation apparatus 930 is replaced with an explosive-induced mechanical translation apparatus 1130, which can be the same as the explosive-induced mechanical translation apparatus 50, the explosive-induced mechanical translation apparatus 70, or the alternative embodiments of apparatus 50 or 70. The explosive-induced mechanical translation apparatus 1130 is mechanically coupled to a lever 1110 (e.g., a boot release member) that is disposed on the sole of the boot 110. In addition, the apparatus 1130 is electrically coupled to an activation circuit 1120 which can be the same as or different than the activation circuit (e.g., electrical circuit 150, battery 160, switch 170, controller 180, and the sensor(s) 190) illustrated in FIGS. 1, 2, 9, and 10.

Figure 12:
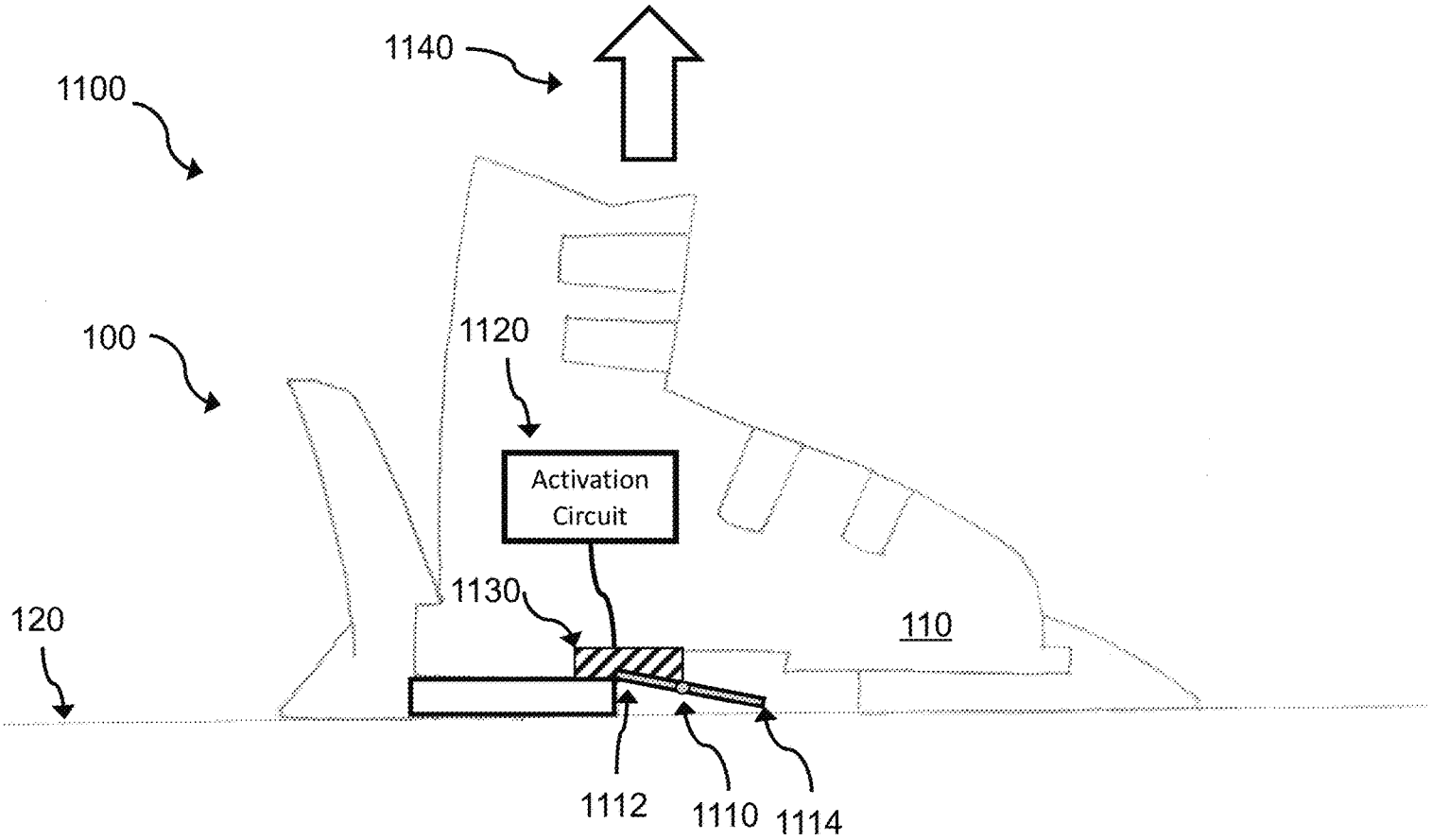
FIG. 12 is a side view of the charge-assisted binding release system illustrated in FIG. 11 in a second state (e.g., an activated state).

When activated (e.g., ignited, reacted, detonated, and/or exploded), the explosive-induced mechanical translation apparatus 1130 pulls a proximal end 1112 of the lever 1110, which causes a distal end 1114 of the lever 1110 to rotate towards the ski 120 as illustrated in FIG. 12, which illustrates in a second state (e.g., an activated state) of the system 1100. When the distal end 1114 of the lever 1110 engages the ski 120, the proximal end 1112 applies an upward force 1140 to the sole or underside of the boot 110 to displace the boot 110 vertically relative to the binding 100 which causes the binding 100 to release the boot 110 (e.g., at the mechanical engagement points of the boot binding assembly). A rod or other mechanical connection can be used to translate the pulling force from the apparatus 1130 to the lever 1110.

The movement of the lever 1110 is in response to and proportional to the energy or force delivered by the activation (e.g., exothermal chemical reaction) of the explosive material 540.

Additionally or alternatively, the system 1100 can be configured and arranged such that explosive-induced mechanical translation apparatus 1130 pushes the distal end 1114 of the lever 1110 (e.g. via a rod or other mechanical connection between the apparatus 1130 and the lever 1110).

The explosive-induced mechanical translation apparatus 1100 can be disposed (e.g., mounted and/or attached) on or in a portion of the boot 110 (e.g., on or in the sole, above the foot bed, behind the calf, etc.). In another embodiment, the charge-assisted binding release system 1100 can be located on the binding 100 and/or on the ski 120. For example, the charge-assisted binding release system 1100 can be located such that an end of the lever 110 (e.g., proximal end 1112 or distal end 1114) engages the sole of the boot 110 to apply an upward force to release the boot 110.

Figure 13:
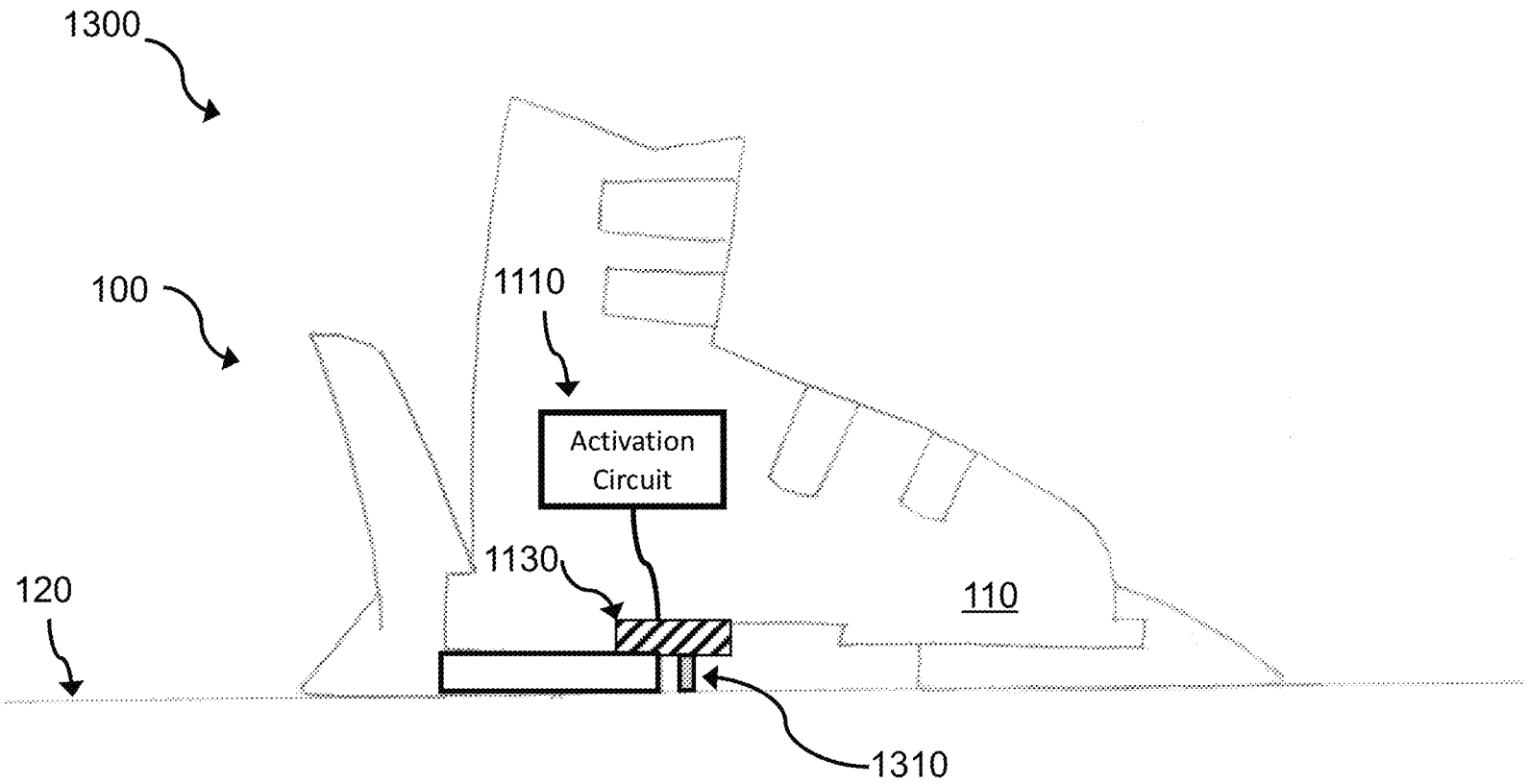
FIG. 13 is a side view of a charge-assisted binding release system in a first state (e.g., a deactivated state) according to another embodiment.

FIG. 13 is a side view of a charge-assisted binding release system 1300 in a first state (e.g., a deactivated state) according to another embodiment. System 1300 is the same as system 1100 except that the explosive-induced mechanical translation apparatus 1130 is mechanically coupled to a rod 1310 (e.g., a boot release member) that is disposed between the apparatus 1130 and the ski 120.

Figure 14:
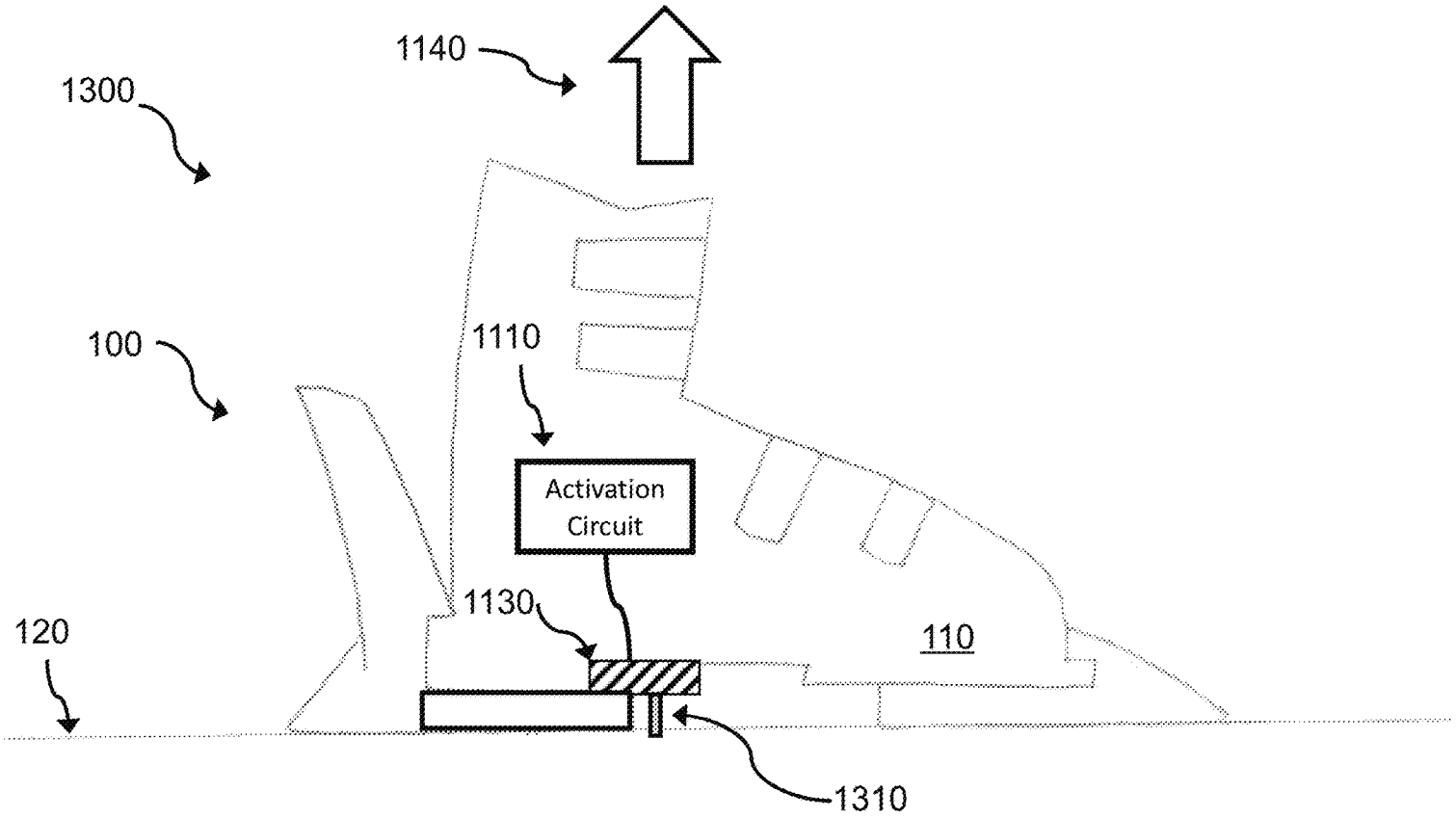
FIG. 14 is a side view of the charge-assisted binding release system illustrated in FIG. 13 in a second state (e.g., an activated state) according to another embodiment.

When activated (e.g., ignited, reacted, detonated, and/or exploded), the explosive-induced mechanical translation apparatus 1130 pushes the rod 1310 towards the ski 120 as illustrated in FIG. 14, which illustrates in a second state (e.g., an activated state) of the system 1300. When the rod 1310 pushes on the ski 120, the rod 1310 applies an upward force 1140 to the sole or underside of the boot 110 to displace the boot 110 vertically relative to the binding 100 which causes the binding 100 to release the boot 110 (e.g., at the mechanical engagement points of the boot binding assembly).

The movement of the rod 1310 is in response to and proportional to the energy or force delivered by the activation (e.g., exothermal chemical reaction) of the explosive material 540.

The explosive-induced mechanical translation apparatus 1300 can be disposed (e.g., mounted and/or attached) on or in a portion of the boot 110 (e.g., on or in the sole, above the foot bed, behind the calf, etc.). In another embodiment, the charge-assisted binding release system 1300 can be located on the binding 100 and/or on the ski 120. For example, the charge-assisted binding release system 1300 can be located such that the rod 1310 pushes on the sole or underside of the boot 110 to cause the binding 100 to release the boot 110.

Figure 15:
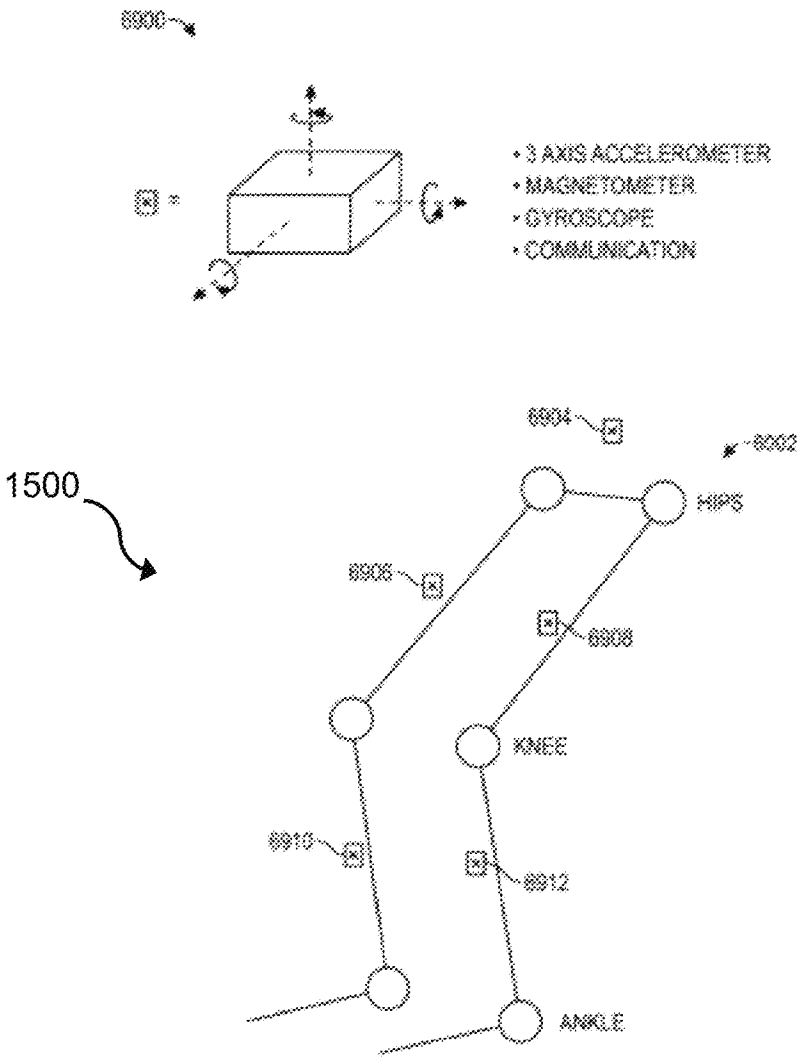
FIG. 15 is a schematic representation of one embodiment of a sensor system.

FIG. 15 is a schematic representation of one embodiment of a sensor system 1500. The sensor system 1500 can be the same as or different than the sensor(s) 190 described above. Thus, the sensor system 1500 can be included in the activation circuit (e.g., activation circuit 1120).

The sensor system 1500 can include a plurality of inertial (or other type) sensors 6900 positioned on a skier 6902. The plurality of sensors 6900 may include a sensor 6904 positioned on a hip of the skier, a sensor 6906 positioned on a right femur of the skier, a sensor 6908 positioned on a left femur of the skier, a sensor 6910 positioned on a right tibia of the skier and a sensor 6912 positioned on a left tibia of the skier. In at least some embodiments, including but not limited to the illustrated embodiment, the sensors 6900 are capable of measuring: (1) three-axis acceleration via a three-axis accelerometer, (2) three-axis rotational velocity via a three-axis gyroscope, and (3) absolute heading via a 3-axis magnetometer. The sensors can also include GPS sensors. In some embodiments, the sensors 6900, alone or in combination, can determine inclination and roll of the skier and/or of the ski boots.

In at least some embodiments, the one or more sensors 6900 (e.g., sensors 6904, 6906, 6908, 6910, and/or 6912), may be positioned to capture orientation of the knee and hip joints. To that effect, each sensor 6900 may be positioned on the leg such that the difference between relative measurements can be used to calculate knee and hip position and motion. The tibia sensors may be positioned in the center-front of the tibia. The femur sensors may be positioned on the center top of the femur. The hip sensor or sensors may be positioned above the crotch and below the belly button where a belt-buckle might fall, central to the skier's hip.

In at least some embodiments, one or more portions of the activation circuit (e.g., activation circuit 1120), such as the sensors, battery, and/or controller may be integrated into or otherwise mounted on clothing or other article(s) worn by a skier.

Figure 16:
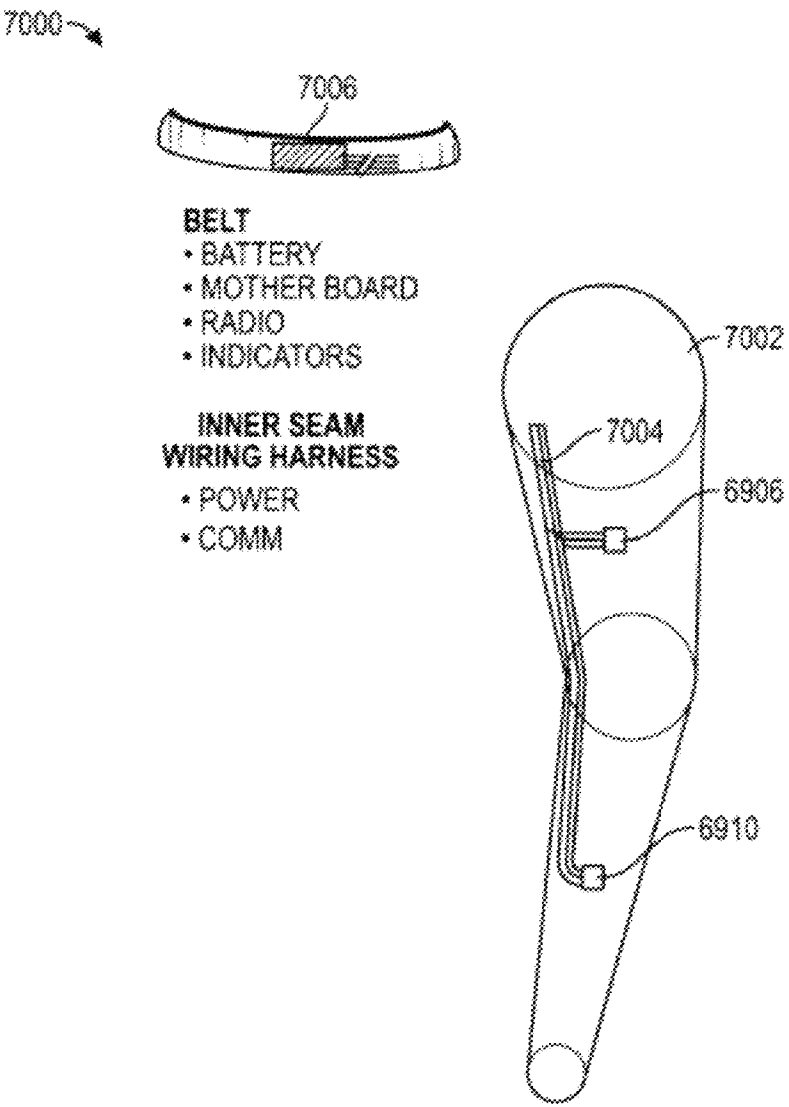
FIG. 16 is a schematic representation of clothing that may be worn by a skier and portions of the activation circuit that may be integrated into or otherwise mounted thereon, in accordance with at least some embodiments.

FIG. 16 is a schematic representation of clothing that may be worn by a skier, e.g., skier 6902, and portions of the activation circuit (e.g., activation circuit 1120) that may be integrated into or otherwise mounted thereon, in accordance with at least some embodiments.

In accordance with at least some embodiments, the clothing that may be worn by a skier, e.g., skier 6902, may include a belt 7000 and a pair of leggings 7002 (thermal or otherwise) (only one leg is shown), which may be stitched into an inner lining of ski pants worn by the skier, or may be independently provided and worn as such.

Sensors to be positioned on the legs of the skier, e.g., sensors 6906-6912 (FIG. 15), may be integrated into or otherwise mounted on the leggings 7002.

A wiring harness (or wiring in any other form) 7004 may distribute power to, and communication signals to and/or from, some or all of the sensors positioned on the legs of the skier. In at least some embodiments, the wiring harness may be routed on an interior seam of the leg to help reduce potential damage from falls and general abuse. In at least some embodiments, the wiring may have the form of a power and communication bus, which may connect the sensors. In some embodiments, the power and/or communication bus may run the length of the leggings 7002.

One or more other portions 7006 of the activation circuit may be integrated into or otherwise mounted on the belt 7000. In at least some embodiments, these other portions may include: (1) a motherboard comprising a microprocessor (e.g., controller 180), (2) a radio for communication to a smart phone and/or a network-enabled device (via Bluetooth or otherwise), (3) a battery (e.g., battery 160), e.g., for powering the activation circuit or portions thereof, (4) battery-charging circuitry, (5) a waist sensor and/or (6) one or more visible network status indicators, integrated into or otherwise mounted on the belt 7000. In at least some embodiments, the motherboard itself includes the (2) radio for communication to: a smart phone and/or a network (Bluetooth or otherwise) enabled device, (3) battery, (4) battery charging circuitry, (5) waist sensor and/or (6) one or more visible network status indicators and is integrated into or otherwise mounted on the circuit board.

Data from the sensors, e.g., sensors 6900-6912 and/or sensor(s) 190, may be sampled (continuously or otherwise) by the microprocessor (e.g., controller 180).

In at least some embodiments, the processing may include a model of the skier. In at least some embodiments, this model is a physiological model is used to "observe" all sensors. In at least some embodiments, the sensor data is supplied to the model which may generate one or more signals in response at least thereto. Sensor data may be combined via a digital filter that incorporates the model to recursively update the current skier orientation, speed, and/or heading. Such data may be used to predict if a potential injury will occur. In at least some embodiments, the ski binding 100 safely releases prior to the injury.

In at least some embodiments, the microprocessor (e.g., controller 180) may be responsible for updating the skier model, determining the release decision (i.e., a decision as to whether to release the ski boot), recording performance data and/or communicating to an application on a user device and/or a separate computer.

In at least some embodiments, the model of the skier may comprise a set of equations relating model inputs and sensor readings. The set of equations may be integrated using a variant of traditional Kalman filtering to output limb and body position, velocity, and muscle activity.

In at least some embodiments, the model of the skier is used within a feedback structure as an "observer" whereby the model is used to inform predictions of future body position, but incorrect predictions can update the model when necessary. In this way, the algorithm is able to predict danger of ACL damage and skier injury (or other unwanted results of an accident in these or other sports and activities).

In at least some embodiments, the activation circuit may include a self-check process that has the purpose of measuring and diagnosing the health of each critical component. In at least some embodiments, the result of the system check is readable via a ski-binding light with pre-programmed sequences (red, yellow, green, blinking red, for example) and/or via a smart phone application which may contain more detailed diagnostics. Each system check result may be tracked via personal profile linked to the binding to alert the skier of component damage of health degradation.

In at least some embodiments, the system check isolates key system features including: (1) binding release mechanism via a current and position monitor, (2) sensor response and calibration via a user sequence of actions and/or (3) software and firmware version control.

In at least some embodiments, if the system-check determines that the system is not suitable for the sport (e.g., skiing), the system does not allow the binding to close and the user is unable to use the binding or it's features. A log may be stored for individual diagnostic troubleshooting.

In at least some embodiments, a wireless controller is installed on the binding or on a ski pole to manually trigger the entry and release of the binding. In at least some embodiments, a system check is performed with each entry of the ski. In at least some embodiments, the user need not access their phone for usage, all controls are ergonomic for glove wearing skier.

There have been numerous studies investigating the proper DIN number (release force setting for ski bindings) for ski bindings across gender and age boundaries that typically consider number of false releases compared to number of ankle and knee injuries caused by a lack of release. In at least some embodiments, an extensive profile of the profile should enable data better correlated for physical conditions most relevant to likelihood of an ACL injury.

In at least some embodiments, the skier model can be initially calibrated to the skier via an extensive physical evaluation. The model may include: (1) a questionnaire with traditional height, weight, skiing ability, gender, age, (2) a model using the sensors for limb length, form, and musculature, (3) a process to update the model based on skiing performance. For example, the forces and positions of the sensor array can be compared against the expectations from the model and updated accordingly and/or (4) a database keeping track of each model, skiing data, and an event log documenting releases and their conditions to better predict misses, false alarms, or hits. (Miss=did not release when it should have, False Alarm (FA)=a release when it should have not, Hit=a release when it should have).

In at least some embodiments, the ski model and data recording may be used by an individual or coach to gauge skier performance for safe and proper ski technique. In at least some embodiments, the system may include software (artificial intelligence software or otherwise) to label where poor or unsafe technique was measured. The software may record the data that would be necessary for visual replay. In at least some embodiments, akin to a race car driver re-driving a racetrack or course, the user will be able to replay their downhill run via a simulator or other similar device.

In at least some embodiments, the system may be used to augment skier performance in real time via auxiliary systems such as: (1) ski stiffeners, (2) muscle/limb enhancements, (3) ski shape deformation and/or (4) trajectory/terrain mapping.

In at least some embodiments, the ski binding system may be a suitable platform for integrating safety features that may be especially useful for off-trail skiing. These may include (1) location tracking, (2) avalanche detection, (3) emergency alert system and/or (4) audible and visual signals.

Figure 17:
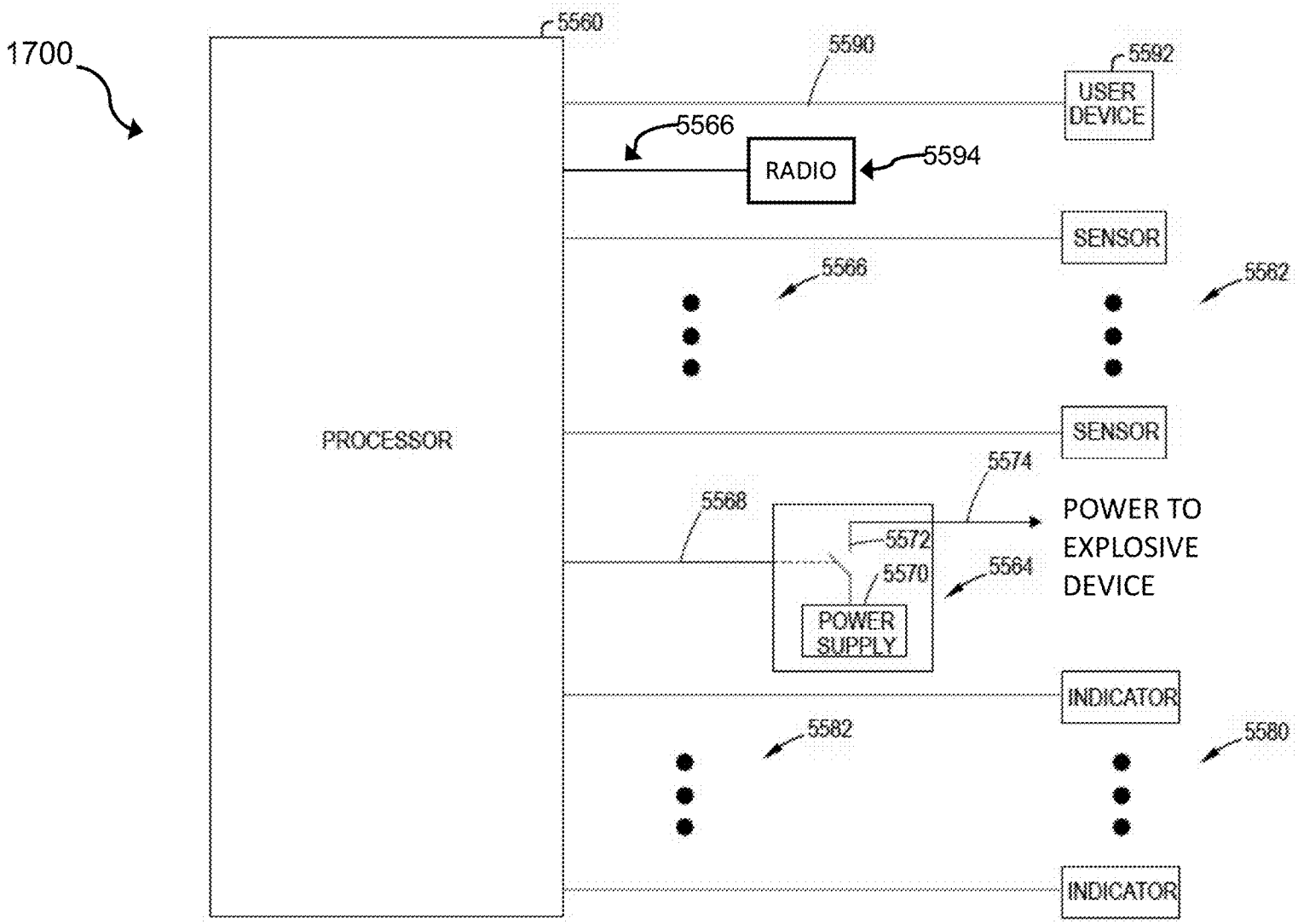
FIG. 17 is a schematic block diagram of one embodiment of an activation circuit.

FIG. 17 is a schematic block diagram of one embodiment of an activation circuit 1700. The activation circuit 1700 can be the same as activation circuit described above, including activation circuit 1120. Any of the explosive devices or explosive materials described herein can be coupled to the activation circuit 1700, such as explosive device 130, explosive-induced expandable apparatus 30 (e.g., explosive material 420), explosive-induced mechanical translation apparatus 50 (e.g., explosive material 540), explosive-induced mechanical translation apparatus 70 (e.g., explosive material 540), explosive-induced mechanical translation apparatus 930, explosive-induced mechanical translation apparatus 1030, and/or explosive-induced mechanical translation apparatus 1130. Thus, the activation circuit 1700 can be used to trigger the activation, ignition, reaction (e.g., exothermal or endothermal reaction) detonation, and/or explosion of the explosive device to release a given ski boot/binding.

The activation circuit 1700 may include a processor circuit 5560, a plurality of sensors (sometimes referred to herein as a sensor system, such as sensor system 1300) 5562, one or more power circuits 5564, and one or more radios 5594. The processor 5560 may comprise any type(s) of processor(s) or microprocessors. In some embodiments, the microprocessor-based controller 180 can comprise the processor 5560. Alternatively, the processor 5560 can comprise the controller 180. In a specific embodiment, the processor 5560 can comprise a microcontroller, such as an LPC5526 microcontroller available from NXP Semiconductors N.V. The plurality of sensors 5562 may comprise any type(s) of sensors, such as sensor(s) 190, 6900-6912. The one or more power circuits 5564 may comprise any type(s) of power circuit(s), including the electrical circuit 150, battery 160, and switch 170.

In at least some embodiments, the one or more power circuits 5564 may comprise one or more power supplies 5570 and one or more power switches 5572 (e.g., which can be same as switch 170). The one or more power supplies 5570 may comprise one or more batteries (rechargeable or otherwise), such as battery 160 (e.g., a 9V battery), and/or any other type of power source(s). The one or more power switch 5572 may comprise one or more power semiconductor devices and/or any other type(s) of power switch(es). In some embodiments, the power supply(ies) 5570 can include a voltage regulator (e.g., to regulate the output voltage of the power supply to a predetermined voltage such as 3V or 3.3V). When the power supply(ies) 5570 include a rechargeable battery, the power supply(ies) 5570 can include a battery charger (e.g., via a physical port such as a USB port) and/or a charge manager (e.g., which allows the activation circuit 1700 to operate during charging by disconnecting the battery).

The radio(s) 5594 can include a short-range and/or a long-range radio, such as Bluetooth radio, a cellular radio, a WiFi radio, or other radio. The radio(s) 5594 can be used to communicate with the user device 5592. Additionally or alternatively, the activation circuit 1700 radio(s) 5594 of the can bcan be used to communicate with a corresponding radio on a second activation circuit to release a second ski boot/binding. For example, the radio(s) 5594 can be used to synchronize activation signals such that when one activation circuit 1700 generates an activation signal (e.g., to release the ski binding for the skier's left boot), the other activation circuit will also generate an activation signal (e.g., to release the ski binding for the skier's right boot).

Alternatively, the radio(s) 5594 can be used to confirm that both activation circuits have independently determined, based on sensor data from the sensors coupled to the respective activation circuits, that the skier has fallen or in another state such that an activation signal should be generated to release the ski binding. This confirmation can be used to prevent unnecessary release of the ski bindings when the skier has not yet fallen. In another embodiment, the sensor data from each activation circuit can be shared between processors 5560 and/or with the user device 5592. In one example, the user device 5592 can determine, based on sensor data from sensors in each activation circuit (e.g., sensors for both boots/legs), whether to release the ski bindings, in which case the user device 5592 can send a user device signal or command to each processor 5560 in each activation circuit 1700 to release the corresponding ski binding.

The activation circuit 1700 may further include a plurality of signal lines or other communication links 5566 that couple the processor 5560 to the plurality of sensors 5562 and to the radio(s) 5594. In addition, the activation circuit 1700 may include one or more control lines or other communication links 5568 that couple the processor 5560 to the one or more power circuits 5564.

The activation circuit 1700 may further comprise one or more power line or other power link(s) 5574 from the one or more power circuit 5564 to the explosive device (e.g., explosive device 130), explosive-induced expandable apparatus 30 (e.g., explosive material 420), explosive-induced mechanical translation apparatus 50 (e.g., explosive material 540), explosive-induced mechanical translation apparatus 70 (e.g., explosive material 540), explosive-induced mechanical translation apparatus 930, explosive-induced mechanical translation apparatus 1030, and/or explosive-induced mechanical translation apparatus 1130).

The activation circuit 1700 may further include a plurality of status indicators 5580 and a plurality of signal lines or other communication links 5582 that couple the processor 5560 to the plurality of status indicators 5580. The plurality of status indicators 5580 may indicate one or more status of the activation circuit 1500 and/or the explosive device. The activation circuit 1700 may further include one or more communication links 5590 to one or more user devices 5592 and/or external components or networks. The user device 5592 may comprise a smartphone, a tablet, and/or any other type of computing device (mobile or otherwise). The communication links 5590 and/or the radio(s) 5594 can be used to send software or firmware updates from the user device 5592 to any portion of the activation circuit 1700.

In at least some embodiments, the user device(s) 5592 can comprise a computing device (e.g., smartphone, tablet, or otherwise) of a user that is using and/or will use the explosive device.

In operation, in at least some embodiments, the processor 5560 receives one or more signals, from one or more of the plurality of sensors 5562 or otherwise, indicative of one or more conditions of the skier, and determines, based at least in part thereon, whether (and/or when) to trigger the activation (e.g., ignition, reaction, detonation, and/or explosion) of the explosive device to initiate release of the boot 110 from the binding 100. In at least some embodiments, if the processor 5560 determines to initiate release, the processor 5560 generates one or more control signals to initiate or trigger release, which may be supplied to the one or more power circuit 5564 via the one or more control lines or other communication link(s) 5568. The one or more power circuits 5564 receives the one or more control signals from the processor 5560 and in response at least thereto, closes the power switch 5572 to provide power to the explosive device via one or more of the one or more power line or other power link(s) 5574. The power provided to the explosive device activates (e.g., ignites, reacts, detonates, and/or explodes) the explosive material contained therein.

In at least some embodiments, the one or more power supply 5570 may comprise one or more rechargeable batteries, such as a lithium ion battery, a lithium polymer battery, and/or a capacitor. The capacitor may in some embodiments comprise part of the laminate of the ski, e.g., ski 102. In some embodiments, the activation circuit 1700 may include piezoelectric transducers that harvest energy from vibrations of the ski, e.g., ski 120, during use and use such energy to recharge the battery and/or capacitor.

In at least some embodiments, the plurality of sensors 5562 may comprise one or more strain gauges, pressure transducers, gyroscopes, accelerometers, magnetometers, and/or other sensors (collectively, sensors). Such sensors can be attached to the ski 120, the boot 110, and/or the skier and/or other equipment or clothing worn by the skier. In some embodiments one or more sensors, e.g. pressure sensors, may be located inside the boot 110, such as between the plastic shell and the soft liner of the boot 110. In some embodiments, the sensors 5562 can be the same as sensors 6900. For example, the sensors 5562 can include a three-axis accelerometer (e.g., to measure three-axis acceleration), a three-axis gyroscope (e.g., to measure three-axis rotational velocity), and/or a 3-axis magnetometer (e.g., to measure absolute heading such as in a compass). The sensors 5562 can also include GPS sensors. In some embodiments, the sensors 5562, alone or in combination, can determine inclination and roll of the skier and/or of the ski boots.

In at least some embodiments, the processor 5560 may continuously receive signals from the plurality of sensors 5562 and determine, based at least in part on such signals, whether (and/or when) to initiate release of the boot 110 from the binding 100.

In at least some embodiments, any of the bindings 100 disclosed herein may include a control system having one or more portions that are the same as and/or similar to one or more portions of the activation circuit 1700 of the binding system 104.

In some embodiments, some or all of the activation circuit 1700 can be included in a system-on-a-chip and/or on a common circuit board.

Figure 18:
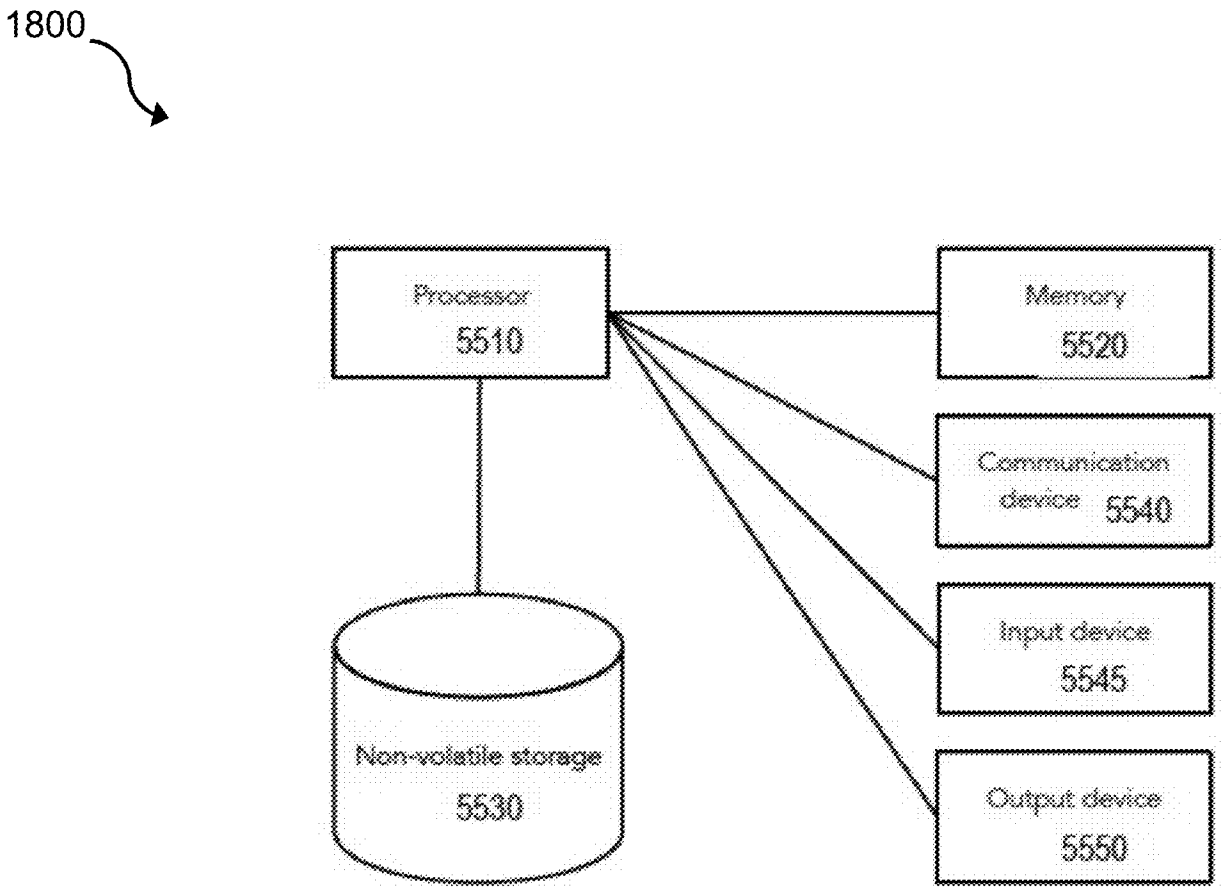
FIG. 18 is a block diagram of an architecture according to some embodiments.

FIG. 18 is a block diagram of an architecture 1800 according to some embodiments. In some embodiments, one or more of the systems (or portion(s) thereof), apparatus (or portion(s) thereof) and/or devices (or portion(s) thereof) disclosed herein may have an architecture that is the same as and/or similar to one or more portions of the architecture 1800.

In some embodiments, one or more of the methods (or portion(s) thereof) disclosed herein may be performed by a system, apparatus and/or device having an architecture that is the same as or similar to the architecture 1800 (or portion(s) thereof). The architecture may be implemented as a distributed architecture or a non-distributed architecture.

The architecture 1800 may include one or more processors 5510 and one or more non-transitory computer-readable storage media (e.g., memory 5520 and/or one or more non-volatile storage media 5530). The processor 5510 may control writing data to and reading data from the memory 5520 and the non-volatile storage device 5530 (e.g., non-transitory computer-readable medium) in any suitable manner. The storage media may store one or more programs and/or other information for operation of the architecture 1600. In at least some embodiments, the one or more programs include one or more instructions to be executed by the processor 5510 to perform one or more portions of one or more tasks and/or one or more portions of one or more methods disclosed herein. In some embodiments, the other information may include data for one or more portions of one or more tasks and/or one or more portions of one or more methods disclosed herein. To perform any of the functionality described herein, the processor 5510 may execute one or more processor-executable instructions stored in one or more non-transitory computer-readable storage media (e.g., the memory 5520 and/or one or more non-volatile storage media 5530).

In at least some embodiments, the architecture 1800 may include one or more communication devices 5540, which may be used to interconnect the architecture to one or more other devices and/or systems, such as, for example, one or more networks in any suitable form, including a local area network or a wide area network, such as an enterprise network, artificial intelligence network, machine learning network, an intelligent network, or the Internet. Such networks may be based on any suitable technology and may operate according to any suitable protocol and may include wireless networks or wired networks.

In at least some embodiments, the architecture 1800 may have one or more input devices 5545 and/or one or more output devices 5550. These devices can be used, among other things, to present a user interface. Examples of output devices that may be used to provide a user interface include printers or display screens for visual presentation of output and speakers or other sound generating devices for audible presentation of output. Examples of input devices that may be used for a user interface include keyboards, and pointing devices, such as mice, touch pads, and digitizing tablets. As another example, the architecture 1800 may receive input information through speech recognition or in other audible formats.

Figure 19:
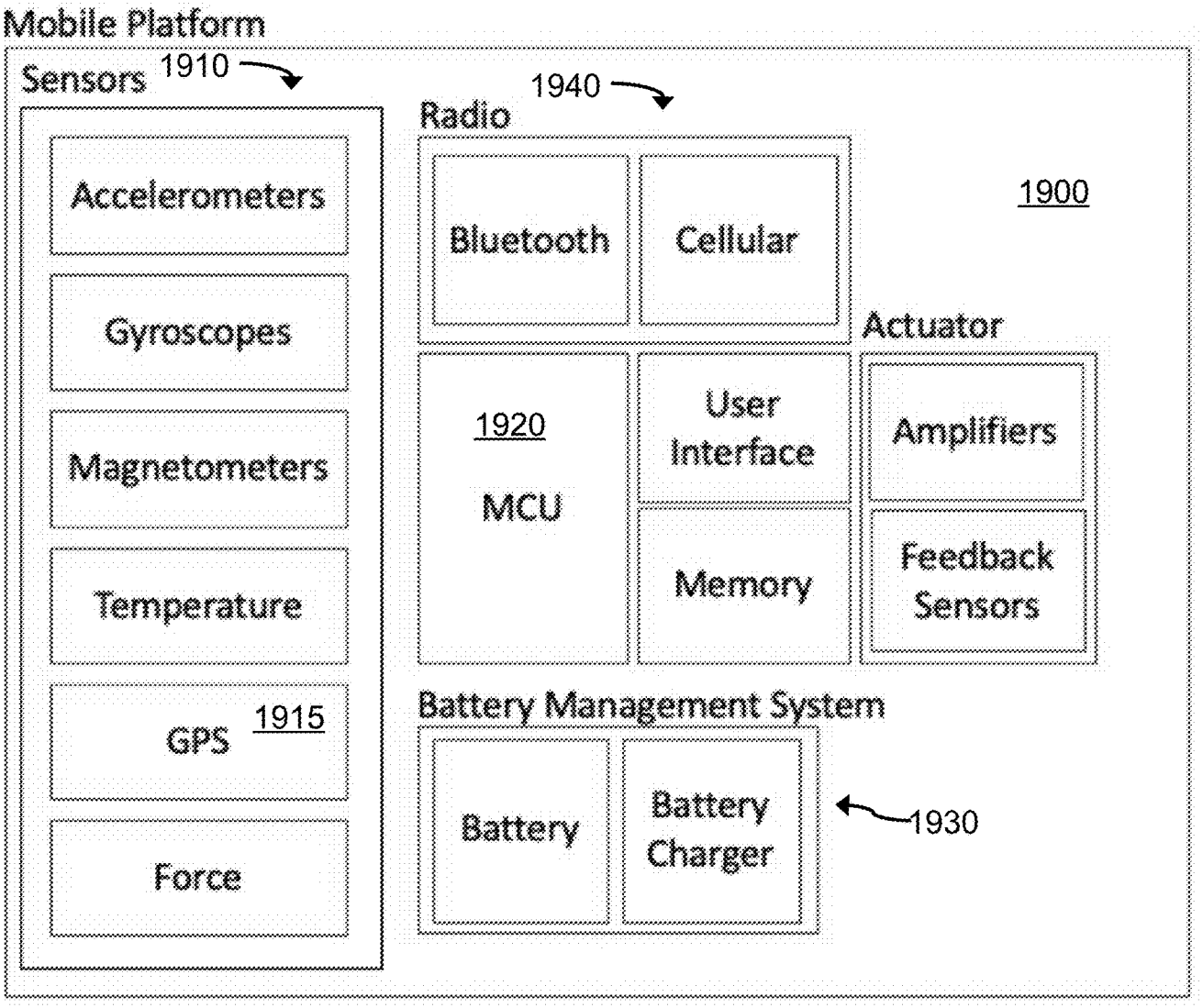
FIG. 19 illustrates an example of a mobile platform configured and arranged according to this disclosure.

FIG. 19 illustrates a mobile platform 1900 configured and arranged according to the present disclosure. The platform 1900 includes sensors 1910, processor circuits 1920, a power supply 1930, and wireless communications 1940. Optionally, the sensors 1910 include a GPS subunit 1915 and other electrical circuitry and components to achieve the above-described features.

Figure 20:
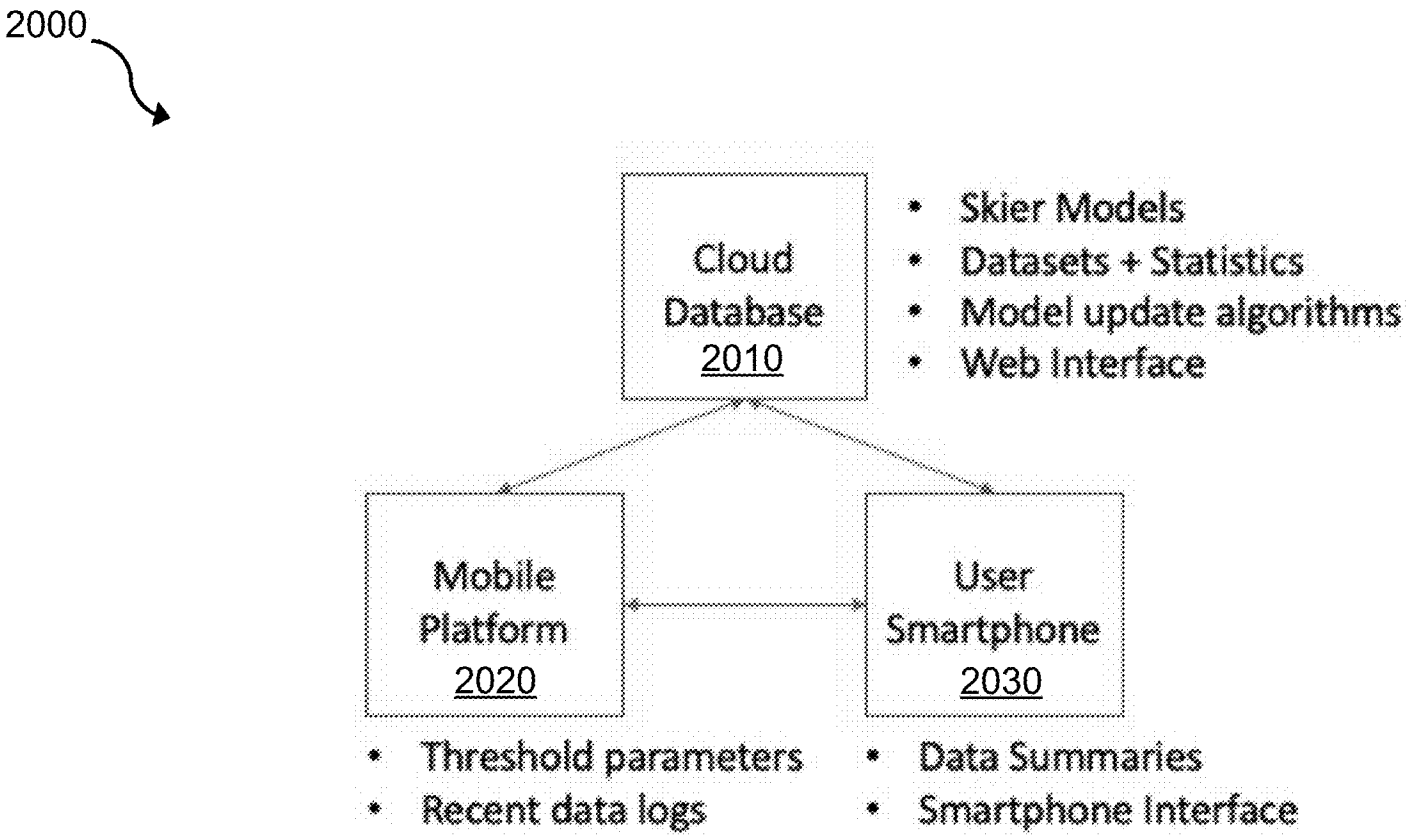
FIG. 20 illustrates a cloud-based or networked architecture that may be used to implement one or more aspects of this disclosure.

FIG. 20 illustrates a cloud-based or networked architecture 2000 for implementing the present system and method, including coupling of a network-accessible database or memory 2010 (e.g., a network-accessible server) and components to a mobile platform 2020, a user device 2030, or other electronic and data processing components. The network-accessible database or memory 2010 can store skier models, datasets, statistics, and model update algorithms, and can provide a web interface to these data. The mobile platform 2020 can store threshold parameters, such as the sensor settings for initiating release of the bindings, and recent data logs. The user device 2030 can store data summaries and provide an interface to the activation circuit.

Figure 21:
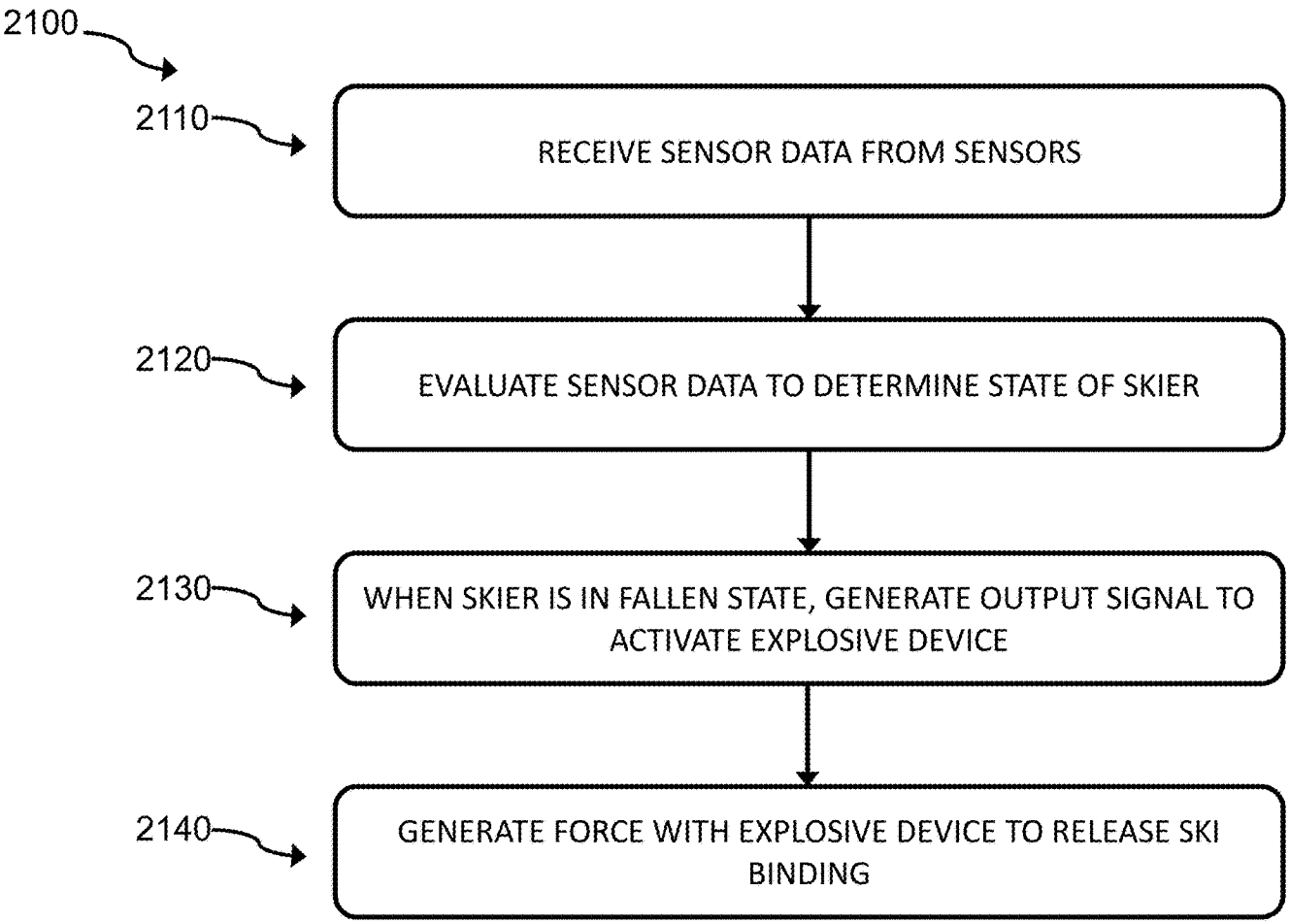
FIG. 21 is a flow chart of a method for generating a charged-induced release of a ski binding according to one or more embodiments

FIG. 21 is a flow chart 2100 of a method for generating a charged-induced release of a ski binding according to one or more embodiments. In step 2110, a microprocessor-based controller receives sensor data from one or more sensors disposed on a skier (e.g., on the skier's body and/or clothing) and/or on the skier's equipment (e.g., ski boots, skis, poles). In step 2120, the controller evaluates the sensor data to determine the state of the skier. For example, the controller can compare the sensor data to a model of the skier. The controller can also evaluate the sensor data for a sudden change in orientation and/or acceleration which may indicate that the skier has fallen (e.g., is in a fallen state).

When the controller determines that the skier is in a fallen state, in step 2130 the controller generates an output signal (e.g., a trigger signal) that activates (e.g., ignites, reacts, detonates, and/or explodes) explosive material in an explosive device. The explosive material has stored chemical energy that can be released upon activation (e.g., via an exothermal chemical reaction). The explosive device can be attached to the skier's ski boot, such as to the sole of the ski boot (e.g., the heel, toe, or arch of the sole). Additionally or alternatively, the explosive device can be attached to the ski and/or to the ski binding. The output signal can cause a power source, such as battery, to form an electrical connection (e.g., through an electrical circuit) to the explosive device. For example, the output signal can cause a switch to change state from a disconnected state to a connected state. In the disconnected state, the power source is not electrically connected to the explosive device. In the connected state, the power source is electrically connected to the explosive device.

In step 2140, the power from the power source activates (e.g., ignites, reacts, detonates, and/or explodes) the explosive device to release the stored chemical energy from the explosive material into a chemical energy reservoir to generate a force sufficient to release the boot from the ski binding. The force sufficient to release the boot from the ski binding can be generated directly from the activation of the explosive device (e.g., as in an explosion) or it can be generated indirectly from the activation of the explosive device (e.g., by moving a boot release member via an actuator assembly). The release force is proportional to and in response to the force delivered by and/or the chemical energy released by the activation of the explosive material.

Having thus described several aspects and embodiments of the technology of this application, it is to be appreciated that various alterations, modifications, and improvements will readily occur to those of ordinary skill in the art. Such alterations, modifications, and improvements are intended to be within the spirit and scope of the technology described in the application. For example, those of ordinary skill in the art will readily envision a variety of other means and/or structures for performing the function and/or obtaining the results and/or one or more of the advantages described herein, and each of such variations and/or modifications is deemed to be within the scope of the embodiments described herein. In addition, though the embodiments has been described with respect to sports equipment for alpine skiing, it is recognized that aspects of the invention are also applicable to cross-country skiing, water skiing, snowboarding, wakeboarding, and/or other ski or board sports.

Those skilled in the art will appreciate the many equivalents to the specific embodiments described herein. It is, therefore, to be understood that the foregoing embodiments are presented by way of example only and that, within the scope of the appended claims and equivalents thereto, inventive embodiments may be practiced otherwise than as specifically described. In addition, any combination of two or more features, systems, articles, materials, kits, and/or methods described herein, if such features, systems, articles, materials, kits, and/or methods are not mutually inconsistent, is included within the scope of the present disclosure.

The above-described embodiments may be implemented in numerous ways. One or more aspects and embodiments of the present application involving the performance of processes or methods may utilize program instructions executable by a device (e.g., a computer, a processor, or other device) to perform, or control performance of, the processes or methods.

In this respect, various inventive concepts may be embodied as a non-transitory computer readable storage medium (or multiple non-transitory computer readable storage media) (e.g., a computer memory, one or more floppy discs, compact discs, optical discs, magnetic tapes, flash memories, circuit configurations in field programmable gate arrays or other semiconductor devices, or other tangible computer storage medium) encoded with one or more programs that, when executed on one or more computers or other processors, perform methods that implement one or more of the various embodiments described above.

The computer readable medium or media may be transportable, such that the program or programs stored thereon may be loaded onto one or more different computers or other processors to implement various one or more of the aspects described above. In some embodiments, computer readable media may be non-transitory media.

The terms "program" and "software" are used herein in a generic sense to refer to any type of computer code or set of computer-executable instructions that may be employed to program a computer or other processor to implement various aspects as described above. Additionally, it should be appreciated that, according to one aspect, one or more computer programs that when executed perform methods of the present application need not reside on a single computer or processor, but may be distributed in a modular fashion among a number of different computers or processors to implement various aspects of the present application.

Computer-executable instructions may be in many forms, such as program modules, executed by one or more computers or other devices. Generally, program modules include routines, programs, objects, components, data structures, etc. that performs particular tasks or implement particular abstract data types. The functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

Also, as described, some aspects may be embodied as one or more methods. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

What is claimed is:

1. An apparatus comprising:

an explosive material;

a battery;

an electrical circuit extending from the explosive material to the battery, the electrical circuit including a switch having a connected state in which the battery and the explosive material are electrically connected through the switch and a disconnected state in which the battery and the explosive material are electrically disconnected;

a processor electrically coupled to the switch, the processor configured to generate an output signal that transitions the switch from the disconnected state to the connected state to activate the explosive material in response to an input signal from one or more sensors;

a cylinder having a moveable internal wall that defines first and second chambers, the explosive material disposed in the first chamber; and a rod or wire having a first end attached to the moveable internal wall and a second end attached to a ski, wherein:

the apparatus is configured to be mounted on or in a ski, a ski boot, and/or a ski binding, and activation of the explosive material generates a gas that increases a pressure in the first chamber, an increase in the pressure in the first chamber causes the moveable internal wall to move towards the second chamber, thereby causing the first end of the rod or wire to move towards the second chamber, the rod or wire passes over a pulley that translates a movement of the first end of the wire in a first direction to a movement of the second end of the wire in a second direction that is opposite to the first direction, and the movement of the second end of the rod or wire causes the ski boot to lift out of a ski binding.

2. The apparatus of claim 1, wherein the apparatus is configured to be mounted on or in the ski boot.

3. The apparatus of claim 2, wherein the apparatus is configured to be mounted on or in a sole of the ski boot.

4. The apparatus of claim 1, wherein the apparatus is configured to be mounted on the ski.

5. The apparatus of claim 4, wherein the apparatus is configured to be mounted on the ski proximal to the ski binding.

6. The apparatus of claim 1, wherein the apparatus is configured to be mounted on the ski binding.

7. A charged-induced ski binding release system, comprising:

a ski;

a ski boot;

a ski binding that releasably secures the ski boot onto the ski;

an explosive material mounted on or in the ski, the ski boot, and/or the ski binding;

a battery;

one or more sensors;

an electrical circuit extending from the explosive material to the battery, the electrical circuit including a switch having a connected state in which the battery and the explosive material are electrically connected through the switch and a disconnected state in which the battery and the explosive material are electrically disconnected;

a processor electrically coupled to the switch, the processor configured to generate an output signal that transitions the switch from the disconnected state to the connected state to activate the explosive material in response to an input signal from the one or more sensors;

a cylinder having a moveable internal wall that defines first and second chambers, the explosive material disposed in the first chamber; and a rod or wire having a first end attached to the moveable internal wall and a second end attached to the ski, wherein:

activation of the explosive material generates a gas that increases a pressure in the first chamber, an increase in the pressure in the first chamber causes the moveable internal wall to move towards the second chamber, thereby causing the first end of the rod or wire to move towards the second chamber, the rod or wire passes over a pulley that translates a movement of the first end of the wire in a first direction to a movement of the second end of the wire in a second direction that is opposite to the first direction, and the movement of the second end of the rod or wire causes the ski boot to lift out of a ski binding.

8. The system of claim 7, wherein the processor:

compares the input signal to a skier model to determine whether a user is in a fallen state, and generates the output signal to release the ski binding when the user is in the fallen state.

9. A processor-controlled snow sport safety system, comprising:

a boot binding assembly having one or more mechanical engagement points at which a snow sport boot is mechanically secured by said boot binding assembly during use in a snow sport;

a chemical energy storage reservoir containing an explosive material which when exploded releases stored energy from said explosive material, in an exothermic reaction, into said chemical energy storage reservoir;

a processor circuit electrically coupled to and receiving one or more input signals from respective one or more sensors, and providing an output signal in response to the one or more input signals, the output signal triggering an explosion of said explosive material within said chemical energy storage reservoir;

an actuator assembly coupled to said chemical energy storage reservoir, the actuator assembly comprising a moveable member that moves into a release position within the actuator assembly in response to and proportionally to a force delivered by said exothermic reaction; and a boot release member, mechanically coupled to said moveable member, which releases said boot from said boot binding from said one or more mechanical engagement points when the moveable member is moved into said release position, the boot release member including a cable connected at a first end to the moveable member of the actuator assembly and at a second end to the boot such that a movement of said moveable member of the actuator assembly causes a corresponding force on said cable, the cable passing over a pulley that translates a movement of the first end of the cable in a first direction to a movement of the second end of the cable in a second direction that is opposite to the first direction, the movement of the second end of the cable causing the boot to lift out of the boot binding assembly.

10. The system of claim 9, wherein said boot release member displaces said snow sport boot in a vertical direction relative to said boot binding assembly upon movement of the moveable member into said release position.

11. The system of claim 9, wherein said actuator assembly comprises a piston within said actuator assembly and said piston is driven by a force from said exothermic reaction.

12. The system of claim 9, wherein the one or more sensors comprise an accelerometer and/or a gyroscope.

13. The system of claim 9, wherein the output signal is a voltage signal triggering said exothermic reaction within said chemical energy storage reservoir.

14. The system of claim 9, wherein said moveable member is part of said boot binding and said boot release member mechanically secures the snow sport boot within the boot binding when not triggered, and releases the snow sport boot from the boot binding when triggered.

15. The apparatus of claim 1, wherein the movement of the second end of the rod or wire produces a force on the ski boot that lifts the ski boot out of the ski binding.

16. The system of claim 7, wherein the movement of the second end of the rod or wire produces a force on the ski boot that lifts the ski boot out of the ski binding.

17. The system of claim 7, wherein the cylinder is mounted on or in the ski boot.

18. The system of claim 17, wherein the cylinder is mounted on or in a sole of the ski boot.

19. The system of claim 7, wherein the cylinder is mounted on the ski.

20. The system of claim 7, wherein the cylinder is mounted on the ski binding.

21. The system of claim 9, wherein the actuator assembly is mounted on or in the boot.

22. The system of claim 21, wherein the actuator assembly is mounted on or in a sole of the boot.

23. The system of claim 9, wherein the actuator assembly is mounted on a ski, the boot binding assembly mechanically secured to the ski.

24. The system of claim 9, wherein the actuator assembly is mounted on the boot binding assembly.

25. The system of claim 9, wherein the corresponding force on said cable lifts the boot out of the boot binding assembly.

* * * * *